US012382982B2

(12) United States Patent
Svensson

(10) Patent No.: US 12,382,982 B2
(45) Date of Patent: Aug. 12, 2025

(54) ORAL PRODUCTS AND METHOD OF MANUFACTURE

(71) Applicant: NICOVENTURES TRADING LIMITED, London (GB)

(72) Inventor: Richard Svensson, Vårgårda (SE)

(73) Assignee: NICOVENTURES TRADING LIMITED, London (GB)

( * ) Notice: Subject to any disclaimer, the term of this patent is extended or adjusted under 35 U.S.C. 154(b) by 437 days.

(21) Appl. No.: 17/848,536

(22) Filed: Jun. 24, 2022

(65) Prior Publication Data

US 2022/0408786 A1 Dec. 29, 2022

Related U.S. Application Data

(60) Provisional application No. 63/215,204, filed on Jun. 25, 2021.

(51) Int. Cl.
*A24B 13/00* (2006.01)
*A24B 15/16* (2020.01)
(Continued)

(52) U.S. Cl.
CPC ..... *A24B 15/16* (2013.01); *A24B 15/285* (2013.01); *A24B 15/303* (2013.01)

(58) Field of Classification Search
CPC ..... A24F 23/02; A24B 13/00; A24B 15/00
(Continued)

(56) References Cited

U.S. PATENT DOCUMENTS 3,339,558 A 9/1967 Waterbury
3,390,686 A 7/1968 Irby et al.
(Continued)

FOREIGN PATENT DOCUMENTS

AU 2004/275843 4/2008
CA 3042133 5/2018
(Continued)

OTHER PUBLICATIONS

English Machine Translation of SE 529886 C2, obtained from PE2E Search (Clarivate Analytics) (Year: 2007).*
(Continued)

*Primary Examiner* — Philip Y Louie
*Assistant Examiner* — Charlotte Davison
(74) *Attorney, Agent, or Firm* — Womble Bond Dickinson (US) LLP

(57) ABSTRACT

A composition adapted for oral use is providing, composition adapted for oral use, including one or more fillers present in a total filler content of about 20% by weight or higher, the one or more fillers comprising a first filler in the form of a dissolving grade pulp material or a non-woody microcrystalline cellulose, the first filler having an untapped bulk density of about 150 g/L or less; and at least one additional component such as active ingredients or flavorants. Also provided is a method of forming a composition adapted for oral use, which includes providing a dry dissolving grade pulp material, grinding the dissolving grade pulp material to form a pulp material having an untapped bulk density of about 150 g/L or less, and mixing the pulp material with at least one additional component such as active ingredients or flavorants.

36 Claims, 4 Drawing Sheets

(51) Int. Cl.
*A24B 15/28* (2006.01)
*A24B 15/30* (2006.01)

(58) Field of Classification Search
USPC ..... 131/274, 352, 359
See application file for complete search history.

(56) References Cited

U.S. PATENT DOCUMENTS 3,550,598 A 12/1970 McGlumphy et al.
3,685,521 A 8/1972 Dock
3,916,914 A 11/1975 Brooks et al.
4,241,093 A 12/1980 Farag et al.
4,305,933 A 12/1981 Wiczer
4,737,323 A 4/1988 Martin et al.
4,889,144 A 12/1989 Tateno et al.
4,997,654 A 3/1991 Corsello et al.
5,004,595 A 4/1991 Cherukuri et al.
5,223,185 A 6/1993 Takei et al.
5,266,300 A 11/1993 Harrison
5,292,528 A 3/1994 Mori et al.
5,387,093 A 2/1995 Takei et al.
5,387,416 A 2/1995 White et al.
5,417,229 A 5/1995 Summers et al.
5,472,002 A 12/1995 Covarrubias
5,525,351 A 6/1996 Dam
5,690,990 A 11/1997 Bonner
5,759,599 A 6/1998 Wampler et al.
5,811,126 A 9/1998 Krishnamurthy
5,882,680 A 3/1999 Suzuki et al.
6,039,901 A 3/2000 Soper et al.
6,045,835 A 4/2000 Soper et al.
6,056,992 A 5/2000 Lew
6,060,078 A 5/2000 Lee
6,106,875 A 8/2000 Soper et al.
6,117,455 A 9/2000 Takada et al.
6,138,683 A 10/2000 Hersh et al.
6,261,589 B1 7/2001 Pearson et al.
6,325,859 B1 12/2001 DeRoos et al.
6,432,440 B1 8/2002 Watts et al.
6,482,433 B1 11/2002 DeRoos et al.
6,596,298 B2 7/2003 Leung et al.
6,612,429 B2 9/2003 Dennen
6,631,722 B2 10/2003 MacAdam et al.
6,719,933 B2 4/2004 Nakamura et al.
6,845,777 B2 1/2005 Pera
6,929,814 B2 8/2005 Bouwmeesters et al.
6,949,256 B2 9/2005 Fonkwe et al.
6,958,143 B2 10/2005 Choi et al.
7,032,601 B2 4/2006 Atchley et al.
7,056,541 B1 6/2006 Stahl et al.
7,067,150 B2 6/2006 Farber et al.
7,115,085 B2 10/2006 Deal
7,494,669 B2 2/2009 Ni et al.
7,507,427 B2 3/2009 Andersen et al.
7,531,192 B2 5/2009 Farber et al.
7,810,507 B2 10/2010 Dube et al.
7,833,555 B2 11/2010 Andersen et al.
7,861,728 B2 1/2011 Holton, Jr. et al.
7,900,637 B2 3/2011 Fagerstrom et al.
7,946,295 B2 5/2011 Brinkley et al.
7,950,399 B2 5/2011 Winterson et al.
8,069,861 B2 12/2011 Sinclair
8,124,147 B2 2/2012 Cheng et al.
8,293,295 B2 10/2012 Andersen et al.
8,336,557 B2 12/2012 Kumar et al.
8,343,532 B2 1/2013 Dam et al.
8,424,541 B2 4/2013 Crawford et al.
8,469,036 B2 6/2013 Williams et al.
8,469,037 B2 6/2013 Liu et al.
8,529,875 B2 9/2013 Andersen
8,529,914 B2 9/2013 Fuisz et al.
8,545,870 B2 10/2013 Dupinay et al.
8,591,967 B2 11/2013 Andersen et al.
8,613,285 B2 12/2013 Fuisz
8,627,828 B2 1/2014 Strickland et al.
8,642,016 B2 2/2014 Chau et al.
8,714,163 B2 5/2014 Kumar et al.
8,741,348 B2 6/2014 Hansson et al.
8,747,562 B2 6/2014 Mishra et al.
8,828,361 B2 9/2014 Anderson
8,833,378 B2 9/2014 Axelsson et al.
8,846,075 B2 9/2014 Johnson et al.
8,858,984 B2 10/2014 Dam et al.
8,863,755 B2 10/2014 Zhuang et al.
8,871,243 B2 10/2014 Fankhauser et al.
8,931,493 B2 1/2015 Sebastian et al.
8,945,593 B2 2/2015 LoCoco et al.
8,978,661 B2 3/2015 Atchley et al.
8,992,974 B2 3/2015 McCarty
9,027,567 B2 5/2015 Gee et al.
9,039,839 B2 5/2015 Beeson et al.
9,044,035 B2 6/2015 Jackson et al.
9,084,439 B2 7/2015 Holton, Jr.
9,155,321 B2 10/2015 Cantrell et al.
9,155,772 B2 10/2015 Gao et al.
9,161,567 B2 10/2015 Shikata et al.
9,161,908 B2 10/2015 Nilsson
9,167,835 B2 10/2015 Sengupta et al.
9,185,931 B2 11/2015 Gao et al.
9,204,667 B2 12/2015 Cantrell et al.
9,237,768 B2 1/2016 Carroll et al.
9,358,296 B2 6/2016 McCarty
9,372,033 B2 6/2016 Lampe et al.
9,375,033 B2 6/2016 Lampe et al.
9,386,800 B2 7/2016 Sebastian et al.
9,402,414 B2 8/2016 Griscik et al.
9,402,809 B2 8/2016 Axelsson et al.
9,402,810 B2 8/2016 Nilsson
9,414,624 B2 8/2016 Carroll et al.
9,420,825 B2 8/2016 Beeson et al.
9,468,233 B2 10/2016 Macko et al.
9,474,303 B2 10/2016 Holton, Jr.
9,521,864 B2 12/2016 Gao et al.
9,565,867 B2 2/2017 Wittorff et al.
9,629,392 B2 4/2017 Holton, Jr.
9,675,102 B2 6/2017 Hunt et al.
9,763,928 B2 9/2017 Duggins et al.
9,775,376 B2 10/2017 Cantrell et al.
9,801,409 B1 10/2017 Smith
9,848,634 B2 12/2017 Fuisz
9,854,830 B2 1/2018 Gao et al.
9,884,015 B2 2/2018 Gao et al.
9,907,748 B2 3/2018 Borschke et al.
9,925,145 B2 3/2018 Hubinette et al.
9,930,909 B2 4/2018 Gao et al.
9,950,858 B2 4/2018 Byrd et al.
9,999,243 B2 6/2018 Gao et al.
10,039,309 B2 8/2018 Carroll et al.
10,045,976 B2 8/2018 Fusco et al.
10,092,715 B2 10/2018 Axelsson et al.
10,130,120 B2 11/2018 Mishra et al.
10,143,230 B2 12/2018 Mishra et al.
10,149,850 B2 12/2018 Mishra et al.
10,172,810 B2 1/2019 McCarty
10,244,786 B2 4/2019 Gao et al.
10,328,023 B2 6/2019 Romanoschi et al.
10,334,873 B2 7/2019 Mishra et al.
10,349,672 B2 7/2019 Gao et al.
10,357,054 B2 7/2019 Marshall et al.
10,369,182 B2 8/2019 Cohen
10,375,984 B2 8/2019 Hernandez Garcia et al.
10,390,557 B2 8/2019 Börjesson et al.
10,426,726 B2 10/2019 Neergaard
10,463,070 B2 11/2019 Carroll et al.
10,517,322 B1 12/2019 Lee
10,532,046 B2 1/2020 Rogers et al.
10,543,205 B2 1/2020 Wittorff et al.
10,881,132 B2 1/2021 Mua et al.
2001/0045215 A1 11/2001 Meyer et al.
2002/0006919 A1 1/2002 Thosar et al.
2003/0224090 A1 4/2003 Pearce et al.
2003/0118628 A1 6/2003 Tutuncu et al.
2003/0220485 A1 11/2003 Ni et al.
2004/0118422 A1 6/2004 Lundin et al.

(56) References Cited

U.S. PATENT DOCUMENTS

2004/0191322 A1 9/2004 Hansson
2004/0224020 A1 11/2004 Schoenhard
2004/0261807 A1 12/2004 Dube et al.
2005/0061339 A1 3/2005 Hansson et al.
2005/0123601 A1 6/2005 Mane et al.
2005/0196437 A1 9/2005 Bednarz et al.
2005/0244521 A1 11/2005 Strickland et al.
2005/0249676 A1 11/2005 Scott et al.
2006/0130861 A1 6/2006 Luan et al.
2006/0144412 A1 7/2006 Mishra et al.
2006/0174901 A1 8/2006 Karles et al.
2006/0191548 A1 8/2006 Strickland et al.
2006/0263414 A1 11/2006 Pan et al.
2006/0272663 A1 12/2006 Dube et al.
2007/0012327 A1 1/2007 Karles et al.
2007/0031539 A1 2/2007 Calton
2007/0062549 A1 3/2007 Holton, Jr. et al.
2007/0082101 A1 4/2007 Weismuller
2007/0092554 A1 4/2007 Lindberg et al.
2007/0095357 A1 5/2007 Besso et al.
2007/0128333 A1* 6/2007 Tuason ..... A23L 19/00
426/615
2007/0148292 A1 6/2007 Royo et al.
2007/0184093 A1 8/2007 Hang
2007/0186941 A1 8/2007 Holton et al.
2007/0261707 A1 11/2007 Winterson et al.
2007/0269386 A1 11/2007 Steen et al.
2008/0029110 A1 2/2008 Dube et al.
2008/0029116 A1 2/2008 Robinson et al.
2008/0029117 A1 2/2008 Mua et al.
2008/0081071 A1 4/2008 Sanghvi et al.
2008/0142025 A1 6/2008 Sinclair
2008/0166395 A1 7/2008 Roush
2008/0202536 A1 8/2008 Torrence et al.
2008/0233245 A1 9/2008 White et al.
2008/0308115 A1 12/2008 Zimmermann
2008/0317911 A1 12/2008 Schleef et al.
2009/0023819 A1 1/2009 Axelsson
2009/0025739 A1 1/2009 Brinkley et al.
2009/0053388 A1 2/2009 Powers et al.
2009/0065013 A1 3/2009 Essen et al.
2009/0095313 A1 4/2009 Fuisz
2009/0142443 A1 6/2009 Robinson et al.
2009/0253754 A1 10/2009 Selmin et al.
2009/0263476 A1 10/2009 Jobdevairakkam et al.
2009/0301504 A1 12/2009 Worthen et al.
2010/0004294 A1 1/2010 Axelsson et al.
2010/0018541 A1 1/2010 Gerardi et al.
2010/0061940 A1 3/2010 Axelsson et al.
2010/0126520 A1 5/2010 Clayton
2010/0187143 A1 7/2010 Essen et al.
2010/0218779 A1* 9/2010 Zhuang ..... A24B 15/183
131/274
2010/0260690 A1 10/2010 Kristensen et al.
2010/0286286 A1* 11/2010 Ikeda ..... A61K 31/166
514/770
2010/0291245 A1 11/2010 Gao et al.
2010/0294292 A1 11/2010 Hodin et al.
2010/0300464 A1 12/2010 Gee et al.
2010/0326454 A1 12/2010 Fuisz
2011/0083680 A1 4/2011 Mishra et al.
2011/0083681 A1 4/2011 Sengupta et al.
2011/0104218 A1 4/2011 Mishra et al.
2011/0129517 A1 6/2011 Rudolph et al.
2011/0139164 A1 6/2011 Mua et al.
2011/0139166 A1 6/2011 Luzenberg, Jr.
2011/0220130 A1 9/2011 Mua et al.
2011/0223297 A1 9/2011 Corkery et al.
2011/0232662 A1 9/2011 Liu et al.
2011/0236536 A1 9/2011 Mongia
2011/0247640 A1 10/2011 Beeson et al.
2011/0268809 A1 11/2011 Brinkley et al.
2011/0274628 A1 11/2011 Borschke
2011/0288132 A1 11/2011 Lindberg
2011/0303232 A1 12/2011 Williams
2012/0031415 A1 2/2012 Essen et al.
2012/0031416 A1 2/2012 Atchley et al.
2012/0037175 A1 2/2012 Cantrell et al.
2012/0039981 A1 2/2012 Pedersen et al.
2012/0103353 A1 5/2012 Sebastian et al.
2012/0128734 A1 5/2012 Hubinette et al.
2012/0138074 A1 6/2012 Cantrell et al.
2012/0138075 A1 6/2012 Jespersen et al.
2012/0177818 A1 7/2012 Trivedi et al.
2013/0005831 A1 1/2013 Rajewski et al.
2013/0074856 A1 3/2013 Holton, Jr.
2013/0078307 A1 3/2013 Holton, Jr. et al.
2013/0098377 A1 4/2013 Borschke et al.
2013/0118512 A1 5/2013 Jackson et al.
2013/0152953 A1 6/2013 Mua et al.
2013/0177646 A1 7/2013 Hugerth et al.
2013/0206115 A1 8/2013 Kragh
2013/0206150 A1 8/2013 Duggins et al.
2013/0206153 A1 8/2013 Beeson et al.
2013/0209540 A1 8/2013 Duggins et al.
2013/0251779 A1 9/2013 Svandal et al.
2013/0263870 A1 10/2013 Cantrell et al.
2013/0276801 A1 10/2013 Byrd, Jr. et al.
2013/0312774 A1 11/2013 Holton, Jr.
2013/0330379 A1 12/2013 Ylipertula et al.
2013/0330417 A1 12/2013 Dong et al.
2013/0340773 A1 12/2013 Sebastian et al.
2014/0130813 A1 5/2014 Strehle
2014/0154301 A1 6/2014 Chau et al.
2014/0234392 A1 8/2014 Hansson et al.
2014/0248367 A1* 9/2014 Lichty ..... A61K 9/1652
264/13
2014/0255452 A1 9/2014 Reddick et al.
2014/0261485 A1 9/2014 Kobai et al.
2014/0271791 A1 9/2014 Mishra et al.
2014/0271946 A1 9/2014 Kobai et al.
2014/0332013 A1 11/2014 Gao et al.
2015/0020818 A1 1/2015 Gao et al.
2015/0068544 A1 3/2015 Moldoveanu et al.
2015/0068545 A1 3/2015 Moldoveanu et al.
2015/0071972 A1 3/2015 Holton, Jr. et al.
2015/0096573 A1 4/2015 Gao et al.
2015/0096574 A1 4/2015 Gao et al.
2015/0096576 A1 4/2015 Gao et al.
2015/0098996 A1 4/2015 Gao et al.
2015/0101627 A1 4/2015 Marshall et al.
2015/0230515 A1 8/2015 Lampe et al.
2015/0231070 A1 8/2015 Huang
2015/0296868 A1 10/2015 Sutton
2015/0368368 A1 12/2015 Retsina et al.
2016/0000140 A1 1/2016 Sebastian et al.
2016/0038552 A1 2/2016 Bredesen et al.
2016/0073657 A1 3/2016 Campomanes et al.
2016/0073676 A1 3/2016 Cantrell et al.
2016/0073689 A1 3/2016 Sebastian et al.
2016/0157515 A1 6/2016 Chapman et al.
2016/0165953 A1 6/2016 Goode, Jr.
2016/0166543 A1 6/2016 Joshi et al.
2016/0186377 A1 6/2016 Haldane et al.
2016/0192703 A1 7/2016 Sebastian et al.
2016/0279056 A1 9/2016 Zhao et al.
2016/0303042 A1 10/2016 Yoshimura et al.
2016/0324777 A1 11/2016 Victor et al.
2017/0007594 A1 1/2017 Borschke
2017/0028672 A1 2/2017 Lim et al.
2017/0099868 A1 4/2017 Gao et al.
2017/0157106 A1 6/2017 Rogers et al.
2017/0164651 A1 6/2017 Mua et al.
2017/0165252 A1 6/2017 Mua et al.
2017/0172995 A1 6/2017 Repaka et al.
2017/0209380 A1 7/2017 Ognibene et al.
2017/0216213 A1 8/2017 Ognibene et al.
2017/0239336 A1 8/2017 Zanetti
2017/0258918 A1 9/2017 Rifkin et al.
2017/0258978 A1 9/2017 Bartlett et al.
2017/0280764 A1 10/2017 Sahlen et al.
2017/0312261 A1 11/2017 Changoer et al.
2017/0318844 A1 11/2017 Gordon
2017/0318858 A1 11/2017 Hodin et al.

(56) References Cited

U.S. PATENT DOCUMENTS

| | | | |
|---|---|---|---|
| 2018/0044856 | A1 | 2/2018 | Dhumpa et al. |
| 2018/0049979 | A1 | 2/2018 | Zhao et al. |
| 2018/0051002 | A1 | 2/2018 | Dull et al. |
| 2018/0140007 | A1 | 5/2018 | Aspgren et al. |
| 2018/0140521 | A1 | 5/2018 | Geonnotti et al. |
| 2018/0140554 | A1 | 5/2018 | Wittorff |
| 2018/0153211 | A1 | 6/2018 | Persson |
| 2018/0235273 | A1 | 8/2018 | Carroll et al. |
| 2018/0255826 | A1 | 9/2018 | Persson et al. |
| 2018/0257801 | A1 | 9/2018 | Persson |
| 2018/0271112 | A1 | 9/2018 | Barkalow et al. |
| 2018/0271139 | A1 | 9/2018 | Aspgren et al. |
| 2018/0338892 | A1 | 11/2018 | Budde et al. |
| 2019/0008766 | A1 | 1/2019 | Favara et al. |
| 2019/0037909 | A1 | 2/2019 | Greenbaum et al. |
| 2019/0083393 | A1 | 3/2019 | Axelsson et al. |
| 2019/0110514 | A1 | 4/2019 | Vetter |
| 2019/0124971 | A1 | 5/2019 | Soffe et al. |
| 2019/0174812 | A1 | 6/2019 | Nielsen et al. |
| 2019/0175581 | A1 | 6/2019 | Nielsen et al. |
| 2019/0246686 | A1 | 8/2019 | Zhuang et al. |
| 2019/0254337 | A1 | 8/2019 | Bjoerkholm |
| 2019/0255035 | A1 | 8/2019 | Bruun |
| 2019/0313689 | A1 | 10/2019 | Beeson et al. |
| 2019/0350862 | A1 | 11/2019 | Wittorf |
| 2020/0037638 | A1 | 2/2020 | Faraci et al. |
| 2020/0128870 | A1 | 4/2020 | Hassler et al. |
| 2020/0138706 | A1 | 5/2020 | Rudraraju et al. |
| 2020/0138783 | A1 | 5/2020 | Rinaldi |
| 2020/0275689 | A1 | 9/2020 | Lewerenz |
| 2020/0297026 | A1 | 9/2020 | Kannisto et al. |
| 2020/0305496 | A1 | 10/2020 | Gessesse |
| 2020/0316012 | A1 | 10/2020 | Schou |
| 2020/0330423 | A1 | 10/2020 | Brunn et al. |
| 2020/0383372 | A1 | 12/2020 | Stahl et al. |
| 2020/0383373 | A1 | 12/2020 | Stahl et al. |
| 2021/0023046 | A1 | 1/2021 | Bruun |
| 2021/0068446 | A1 | 3/2021 | Keller et al. |
| 2022/0225659 | A1 | 7/2022 | Gessesse et al. |
| 2022/0295858 | A1 | 9/2022 | Holton, Jr. et al. |
| 2022/0295867 | A1 | 9/2022 | Holton, Jr. et al. |

FOREIGN PATENT DOCUMENTS

| | | | | |
|---|---|---|---|---|
| CA | 3040513 | | 10/2020 | |
| CN | 103005680 | A | 4/2013 | |
| CN | 103263507 | A | 8/2013 | |
| CN | 103494324 | A | 1/2014 | |
| CN | 104770860 | A | 7/2015 | |
| CN | 105192876 | A | 12/2015 | |
| CN | 105595404 | A | 5/2016 | |
| CN | 105916603 | | 8/2016 | |
| CN | 105918603 | | 9/2016 | |
| CN | 106805287 | A | 6/2017 | |
| CN | 107259632 | A | 10/2017 | |
| CN | 108649170 | | 10/2018 | |
| DE | 19524197 | A1 | 9/1997 | |
| EP | 2177213 | A1 | 4/2010 | |
| EP | 2417967 | | 2/2012 | |
| EP | 2640204 | | 9/2013 | |
| EP | 1951074 | B1 | 7/2014 | |
| EP | 2804498 | | 11/2014 | |
| EP | 2891408 | | 7/2015 | |
| EP | 3087852 | | 11/2016 | |
| GB | 2487808 | A | 8/2012 | |
| JP | 2004/161719 | | 6/2004 | |
| SE | 529886 | C2 * | 12/2007 | ..... A23L 1/3002 |
| SE | 1750488 | | 10/2018 | |
| SE | 541198 | C2 | 4/2019 | |
| WO | WO 96/31255 | | 10/1996 | |
| WO | WO 97/012605 | | 4/1997 | |
| WO | WO 00/013662 | | 3/2000 | |
| WO | WO 02/080707 | | 10/2002 | |
| WO | WO 03/039518 | | 5/2003 | |
| WO | WO 03/053175 | | 7/2003 | |
| WO | WO 2004/000273 | | 12/2003 | |
| WO | WO 2004/056219 | | 7/2004 | |
| WO | WO 2004/056363 | | 7/2004 | |
| WO | WO 2004/095959 | | 11/2004 | |
| WO | WO 2005/041699 | | 5/2005 | |
| WO | WO 2005/046363 | | 5/2005 | |
| WO | WO 2005/063060 | | 7/2005 | |
| WO | WO 2006/000232 | | 1/2006 | |
| WO | WO 2007/037962 | | 4/2007 | |
| WO | WO 2007/053098 | | 5/2007 | |
| WO | WO 2007/126361 | | 11/2007 | |
| WO | WO 2008/056135 | | 5/2008 | |
| WO | WO 2008/103935 | | 8/2008 | |
| WO | WO 2009/015142 | | 1/2009 | |
| WO | WO 2009/067734 | | 6/2009 | |
| WO | WO 2009/108769 | | 9/2009 | |
| WO | WO 2010/125516 | | 11/2010 | |
| WO | WO 2010/134025 | | 11/2010 | |
| WO | WO 2010/139987 | | 12/2010 | |
| WO | WO 2011/081725 | | 7/2011 | |
| WO | WO 2011/117740 | | 9/2011 | |
| WO | WO 2013/109961 | | 7/2013 | |
| WO | WO 2013/119760 | | 8/2013 | |
| WO | WO 2013/119799 | | 8/2013 | |
| WO | WO 2015/051308 | | 4/2015 | |
| WO | WO 2015/067372 | | 5/2015 | |
| WO | WO 2015/075745 | | 5/2015 | |
| WO | WO 2015/117011 | | 8/2015 | |
| WO | WO 2015/160842 | | 10/2015 | |
| WO | WO 2015/193379 | | 12/2015 | |
| WO | WO 2016/067226 | | 5/2016 | |
| WO | WO 2016/075371 | | 5/2016 | |
| WO | WO 2016/090075 | | 6/2016 | |
| WO | WO 2016/144376 | | 9/2016 | |
| WO | WO 2016/147186 | | 9/2016 | |
| WO | WO 2016/164470 | | 10/2016 | |
| WO | WO 2018/009139 | | 1/2018 | |
| WO | WO 2018/029626 | | 2/2018 | |
| WO | WO 2018/197454 | | 11/2018 | |
| WO | WO 2018/233782 | | 12/2018 | |
| WO | WO 2019/005889 | | 1/2019 | |
| WO | WO 2019/036243 | | 2/2019 | |
| WO | WO 2019/094745 | | 5/2019 | |
| WO | WO 2019/115778 | | 6/2019 | |
| WO | WO 2019/135224 | | 7/2019 | |
| WO | WO 2019/140406 | | 7/2019 | |
| WO | WO 2019/219147 | | 11/2019 | |
| WO | WO 2019/245639 | | 12/2019 | |
| WO | WO 2020/236798 | | 11/2020 | |
| WO | WO 2021/086367 | | 5/2021 | |

OTHER PUBLICATIONS

Acton et al., Chapter 3: Esterases from "Hydrolases—Advances in Research and Publication," 2003, p. 160.

Ali Ashjaran et al: "Overview of bionanofabric from bacterial cellulose", The Journal of the Textile Institute, vol. 104, No. 2,Feb. 1, 2013, pp. 121-131.

Cash, M.J. et al., "Cellulose Derivatives," Imelson, Alan, Food Stabilisers, Thickeners and Gelling Agents, 2010, Blackwell Publishing Ltd., 1st Edition, p. 95-113.

Dhifi et al., "Essential Oils' Chemical Characterization and Investigation of Some Biological Activities: A critical Review" *Medicines*, 2016, 3, 25, pp. 1-16. www.mdpi.com/journal/medicines.

Dvoryanchikov, Gennady et al., "GABA, its receptors, and GABAergic inhibition in mouse taste buds" J. Neurosci. Apr. 13, 2011;31(15):5782-91.

Ester, Valerate, "Chemical Entities of Biological Interest," European Molecular Biology Laboratory, 2019, https://www.ebi.ac.uk/chebi/searchld.do?chebild-CHEBI:50871.

Fernandes et al., "Manufacture and Characterization of Mucoadhesive Buccal Films Based on Pectin and Gellan Gum Containing Triamcinolone Acetonide," *International Journal of Polymer Science*, vol. 2018, pp. 1-10.

Friedman et al., "Cinnamaldehyde Content in Foods Determined by Gas Chromatography-Mass Spectrometry," 2000, Journal of Agricultural and Food Chemistry, vol. 48, No. 11, pp. 5702-5709.

(56) References Cited

OTHER PUBLICATIONS

Guntert in Takeoka, et al., "Flavor Chemistry of Peppermint Oil (*Mentha piperita* L.)," Aroma Active Compounds in Foods ACS Symposium Series; American Chemical Society: Washington, DC 2001.
Lee et al., "Gums, Jellies and Pastilles," in Sugar Confectionery and Chocolate Manufacture, 1973, pp. 226-255.
Liu, Qingqing et al., "Food-Grade Nanoemulsions: Preparation, Stability and Application in Encapsulation of Bioactive Compounds" Molecules 2019, 24, 4242-4279.
Mohammaei et al: "Coefficient partition prediction of saturated monocarboxylic acids using the molecular descriptors", Journal of the Chilean Chemical Society, vol. 63, No. 3, 2018, pp. 4068-4071.
Nestor et al., "Role of Oxides of Nitrogen in Tobacco-Specific Nitrosamine Formation in Flue-Cured Tobacco" Beitrage Tabakforsch. Int., 20, 467-475 (2003).
Niesz, Krisztian, et al., "Sol-gel Synthesis of ordered mesoporous alumina," Chem. Commun., 2005, pp. 1986-1987.
Onal et al., "Some Physicochemical Properties Of The White Sepiolite Known As Pipestone From Kskisehir, Turkey," 2008, Clays and Clay Minerals, vol. 56, No. 5, pp. 511-519.
Perfetti, T. A. "Structural study of nicotine salts" Beitrage Tabakforschung Int., 12: 43-54 (1983).
Robichaud Meagan et al., "Tobacco companies introduce 'tobacco free' nicotine pouches", Tobacco Control, Nov. 21, 2019, 1-2, National Library of Medicine, doi:10.1136/tobaccocontrol-2019-055321.
Roton et al., "Factors Influencing the Formation of Tobacco-Specific Nitrosamines in French Air-Cured Tobaccos in Trials and at the Farm Level" Beitrage Tabakforsch. Int., 21, 305-320 (2005).
Shit, Subhas et al., "Edible Polymers: Challenges and Opportunities", Journal of Polymers vol. 2014, Article ID 427259, 13 pages; http://dx.doi.org/10.1155/2014/427259.
Staaf et al., "Formation of Tobacco-Specific Nitrosamines (TSNA) During Air-Curing: Conditions and Control" Beitrage Tabakforsch. Int., 21, 321-330 (2005).
Szel, et al., "Anti-irritant and anti-inflammatory effects of glycerol and xylitol in sodium lauryl sulphate-induced acute irritation," The Journal of European Academy of Dermatology and Venereology, vol. 29, Issue 12, Dec. 2015, 2333-2341.
Umashankar et al., Chewable Lozenges Formulation a Review, International Research Journal of Pharmacy, 2016, 7(4), 9-16.
Vieira, Melissa et al., "Natural-based plasticizers and biopolymer films: A review", European Polymer Journal 47, (2011), 254-263.
V2 Cigs UK, "What is Synthetic Nicotine and is it safe?" Sep. 11, 2019, (https://www.buyv2cigs.co.uk/).

* cited by examiner

ORAL PRODUCTS AND METHOD OF MANUFACTURE

CROSS-REFERENCE TO RELATED APPLICATIONS

The present application is claims the benefit of and priority to U.S. Provisional Patent Application No. 63/215,204, filed Jun. 25, 2021, the disclosure of which is incorporated herein by reference in its entirety.

FIELD OF THE DISCLOSURE

The present disclosure relates to compositions intended for human use. The compositions are configured for oral use and deliver substances such as flavors and/or active ingredients during use. Such products may include tobacco or a product derived from tobacco, or may be tobacco-free alternatives.

BACKGROUND

Tobacco may be enjoyed in a so-called "smokeless" form. Particularly popular smokeless tobacco products are employed by inserting some form of processed tobacco or tobacco-containing formulation into the mouth of the user. Conventional formats for such smokeless tobacco products include moist snuff, snus, and chewing tobacco, which are typically formed almost entirely of particulate, granular, or shredded tobacco, and which are either portioned by the user or presented to the user in individual portions, such as in single-use pouches or sachets. Other traditional forms of smokeless products include compressed or agglomerated forms, such as plugs, tablets, or pellets. Alternative product formats, such as tobacco-containing gums and mixtures of tobacco with other plant materials, are also known. See for example, the types of smokeless tobacco formulations, ingredients, and processing methodologies set forth in U.S. Pat. No. 1,376,586 to Schwartz; U.S. Pat. No. 4,513,756 to Pittman et al.; U.S. Pat. No. 4,528,993 to Sensabaugh, Jr. et al.; U.S. Pat. No. 4,624,269 to Story et al.; U.S. Pat. No. 4,991,599 to Tibbetts; U.S. Pat. No. 4,987,907 to Townsend; U.S. Pat. No. 5,092,352 to Sprinkle, III et al.; U.S. Pat. No. 5,387,416 to White et al.; U.S. Pat. No. 6,668,839 to Williams; U.S. Pat. No. 6,834,654 to Williams; U.S. Pat. No. 6,953,040 to Atchley et al.; U.S. Pat. No. 7,032,601 to Atchley et al.; and U.S. Pat. No. 7,694,686 to Atchley et al.; US Pat. Pub. Nos. 2004/0020503 to Williams; 2005/0115580 to Quinter et al.; 2006/0191548 to Strickland et al.; 2007/0062549 to Holton, Jr. et al.; 2007/0186941 to Holton, Jr. et al.; 2007/0186942 to Strickland et al.; 2008/0029110 to Dube et al.; 2008/0029116 to Robinson et al.; 2008/0173317 to Robinson et al.; 2008/0209586 to Neilsen et al.; 2009/0065013 to Essen et al.; and 2010/0282267 to Atchley, as well as WO2004/095959 to Arnarp et al., each of which is incorporated herein by reference.

Smokeless tobacco product configurations that combine tobacco material with various binders and fillers have been proposed more recently, with example product formats including lozenges, pastilles, gels, extruded forms, and the like. See, for example, the types of products described in US Patent App. Pub. Nos. 2008/0196730 to Engstrom et al.; 2008/0305216 to Crawford et al.; 2009/0293889 to Kumar et al.; 2010/0291245 to Gao et al; 2011/0139164 to Mua et al.; 2012/0037175 to Cantrell et al.; 2012/0055494 to Hunt et al.; 2012/0138073 to Cantrell et al.; 2012/0138074 to Cantrell et al.; 2013/0074855 to Holton, Jr.; 2013/0074856 to Holton, Jr.; 2013/0152953 to Mua et al.; 2013/0274296 to Jackson et al.; 2015/0068545 to Moldoveanu et al.; 2015/0101627 to Marshall et al.; and 2015/0230515 to Lampe et al., each of which is incorporated herein by reference.

All-white snus portions are growing in popularity, and offer a discrete and aesthetically pleasing alternative to traditional snus. Such modern "white" pouched products may include a bleached tobacco or may be tobacco-free. There is a continuing need in the art to lower the environmental impact of such pouched products while retaining acceptable sensory properties.

BRIEF SUMMARY

The present disclosure provides products configured for oral use, the products including one or more fillers in an amount of at least 20% by weight, based on the total weight of the composition, the one or more fillers typically comprising at least one non-tobacco cellulosic material having a bulk density of about 100 g/L or less. The composition further includes at least one additional component selected from the group consisting of active ingredients, flavorants, and combinations thereof. The disclosure includes, without limitations, the following embodiments.

Embodiment 1

A composition adapted for oral use, comprising: one or more fillers present in a total filler content of about 20% by weight or higher, based on the total weight of the composition, the one or more fillers comprising a first filler in the form of a dissolving grade pulp material or a non-woody microcrystalline cellulose, the first filler having an untapped bulk density of about 150 g/L or less; and at least one additional component selected from the group consisting of active ingredients, flavorants, and combinations thereof.

Embodiment 2

The composition of Embodiment 1, wherein the dissolving grade pulp material is derived from a plant source selected from the group consisting of wood sources, agricultural residue sources, annual plants and grasses, recycled plant material, and combinations thereof.

Embodiment 3

The composition of any one of Embodiments 1-2, wherein the dissolving grade pulp material is derived from a plant source selected from the group consisting of maize, oat, rice, barley, rye, buckwheat, sugar beet, bran, bamboo, hardwood, softwood, cotton, citrus, willow, cocoa, abaca, bagasse, esparto, eucalyptus, hemp, jute, kenaf, flax, sisal, and combinations thereof.

Embodiment 4

The composition of any one of Embodiments 1-3, wherein the dissolving grade pulp material is a hardwood or softwood dissolving grade pulp or a wheat straw dissolving grade pulp.

Embodiment 5

The composition of any one of Embodiments 1-4, wherein the dissolving grade pulp material has an untapped bulk density in the range of about 15 g/L to about 50 g/L.

Embodiment 6

The composition of any one of Embodiments 1-5, wherein the non-woody microcrystalline cellulose is derived from a plant source selected from the group consisting of agricultural residue sources, annual plants and grasses, recycled plant material, and combinations thereof.

Embodiment 7

The composition of any one of Embodiments 1-6, wherein the non-woody microcrystalline cellulose is derived from a plant source selected from the group consisting of maize, oat, rice, barley, rye, buckwheat, sugar beet, bran, bamboo, cotton, citrus, willow, cocoa, abaca, bagasse, esparto, eucalyptus, hemp, jute, kenaf, flax, sisal, and combinations thereof.

Embodiment 8

The composition of any one of Embodiments 1-7, wherein the non-woody microcrystalline cellulose has an untapped bulk density in the range of about 40 to about 120 g/L.

Embodiment 9

The composition of any one of Embodiments 1-8, wherein the first filler is present in an amount in the range of about 2 to about 10 weight percent, based on the total weight of the composition.

Embodiment 10

The composition of any one of Embodiments 1-9, wherein the first filler is present in an amount in the range of about 3 to about 6 weight percent, based on the total weight of the composition.

Embodiment 11

The composition of any one of Embodiments 1-10, wherein the total filler content is about 30 weight percent or higher, based on the total weight of the composition.

Embodiment 12

The composition of any one of Embodiments 1-11, wherein the total filler content is about 40 weight percent or higher, based on the total weight of the composition.

Embodiment 13

The composition of any one of Embodiments 1-12, wherein the total filler content is in the range of about 20 weight percent to about 60 weight percent, based on the total weight of the composition.

Embodiment 14

The composition of any one of Embodiments 1-13, further comprising a second filler in the form of a non-tobacco cellulosic material having a bulk density of about 250 g/L or higher.

Embodiment 15

The composition of Embodiment 14, wherein the non-tobacco cellulosic material has a bulk density in the range of about 250 g/L to about 1200 g/L.

Embodiment 16

The composition of any one of Embodiments 14-15, wherein the non-tobacco cellulosic material is microcrystalline cellulose, such as microcrystalline cellulose derived from a wood source.

Embodiment 17

The composition of Embodiment 16, wherein the microcrystalline cellulose has a particle size in the range of about 75 microns to about 150 microns.

Embodiment 18

The composition of any one of Embodiments 14-17, wherein the second filler is in particulate form and the first filler is in fibrous form.

Embodiment 19

The composition of any one of Embodiments 1-18, wherein the composition has a moisture content of about 30% by weight or higher, based on the total weight of the composition.

Embodiment 20

The composition of any one of Embodiments 1-19, wherein the moisture content of the composition is in the range of about 30 weight percent to about 60 weight percent, based on the total weight of the composition.

Embodiment 21

The composition of any one of Embodiments 1-20, wherein the moisture content of the composition is in the range of about 40 weight percent to about 55 weight percent, based on the total weight of the composition.

Embodiment 22

The composition of any one of Embodiments 1-21, wherein the at least one additional component comprises at least one active ingredient selected from the group consisting of botanical materials, stimulants, amino acids, vitamins, antioxidants, cannabinoids, cannabimimetics, terpenes, pharmaceutical agents, and combinations thereof.

Embodiment 23

The composition of any one of Embodiments 1-22, further comprising one or more of the following: a salt, a sweetener, a buffer, a humectant, a binder, and combinations thereof.

Embodiment 24

The composition of any one of Embodiments 1-23, wherein the composition comprises up to about 5 weight percent of tobacco, based on the total weight of the composition, the tobacco optionally being in a bleached form.

Embodiment 25

The composition of any one of Embodiments 1-24, wherein the composition is substantially free of tobacco.

Embodiment 26

The composition of any one of Embodiments 1-25, wherein the composition is substantially free of nicotine.

Embodiment 27

The composition of any one of Embodiments 1-25, wherein the composition comprises a nicotine component.

Embodiment 28

The composition of any one of Embodiments 1-27, wherein the composition is enclosed in a pouch to form a pouched product.

Embodiment 29

A method of forming a composition adapted for oral use, comprising: providing a dissolving grade pulp material having a moisture content of about 10% or less; grinding the dissolving grade pulp material to form a pulp material having an untapped bulk density of about 150 g/L or less; mixing the pulp material with at least one additional component selected from the group consisting of active ingredients, flavorants, and combinations thereof to form an oral composition adapted for oral use.

Embodiment 30

The method of Embodiment 29, wherein the dissolving grade pulp material is in a flake or sheet form prior to grinding.

Embodiment 31

The method of any one of Embodiments 29-30, further comprising mixing the pulp material with a non-tobacco cellulosic material having a bulk density of about 250 g/L or higher.

Embodiment 32

The method of Embodiment 31, wherein the non-tobacco cellulosic material is a wood-derived microcrystalline cellulose material.

Embodiment 33

The method of any one of Embodiments 29-32, wherein the dissolving grade pulp material is derived from a plant source selected from the group consisting of wood sources, agricultural residue sources, annual plants and grasses, recycled plant material, and combinations thereof.

Embodiment 34

The method of any one of Embodiments 29-33, wherein the dissolving grade pulp material is derived from a plant source selected from the group consisting of maize, oat, rice, barley, rye, buckwheat, sugar beet, bran, bamboo, hardwood, softwood, cotton, citrus, willow, cocoa, abaca, bagasse, esparto, eucalyptus, hemp, jute, kenaf, flax, sisal, and combinations thereof.

Embodiment 35

The method of any one of Embodiments 29-34, wherein the dissolving grade pulp material is a hardwood or softwood dissolving grade pulp or a wheat straw dissolving grade pulp.

Embodiment 36

The method of any one of Embodiments 29-35, wherein the pulp material has an untapped bulk density in the range of about 15 g/L to about 50 g/L.

These and other features, aspects, and advantages of the disclosure will be apparent from a reading of the following detailed description together with the accompanying drawings, which are briefly described below. The invention includes any combination of two, three, four, or more of the above-noted embodiments as well as combinations of any two, three, four, or more features or elements set forth in this disclosure, regardless of whether such features or elements are expressly combined in a specific embodiment description herein. This disclosure is intended to be read holistically such that any separable features or elements of the disclosed invention, in any of its various aspects and embodiments, should be viewed as intended to be combinable unless the context clearly dictates otherwise.

BRIEF DESCRIPTION OF THE DRAWINGS

Having thus described aspects of the disclosure in the foregoing general terms, reference will now be made to the accompanying drawings, which are not necessarily drawn to scale. The drawings are exemplary only, and should not be construed as limiting the disclosure.

Figure 1:
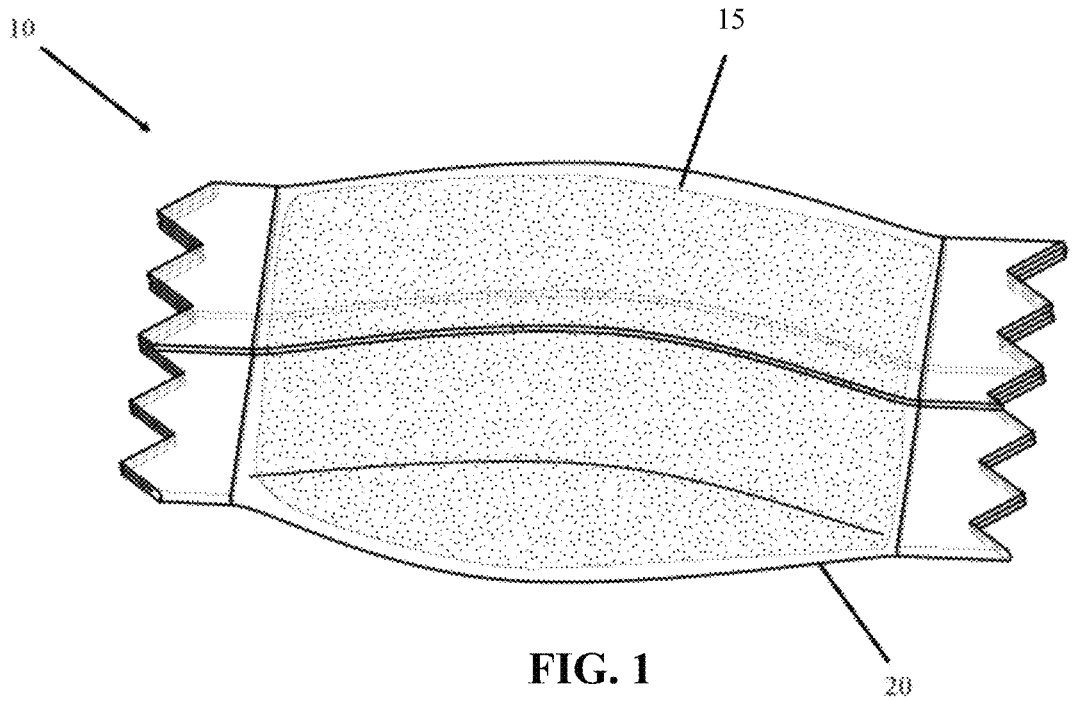
Figure 2:
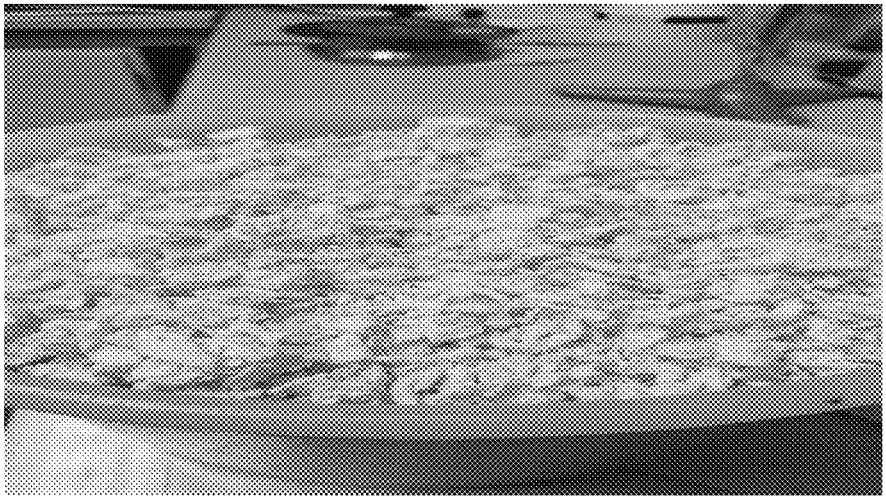
Figure 3A:
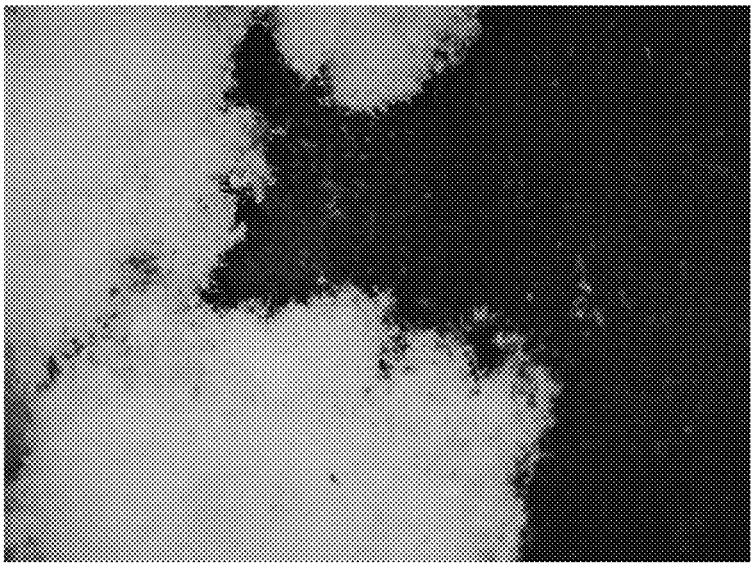
Figure 3B:
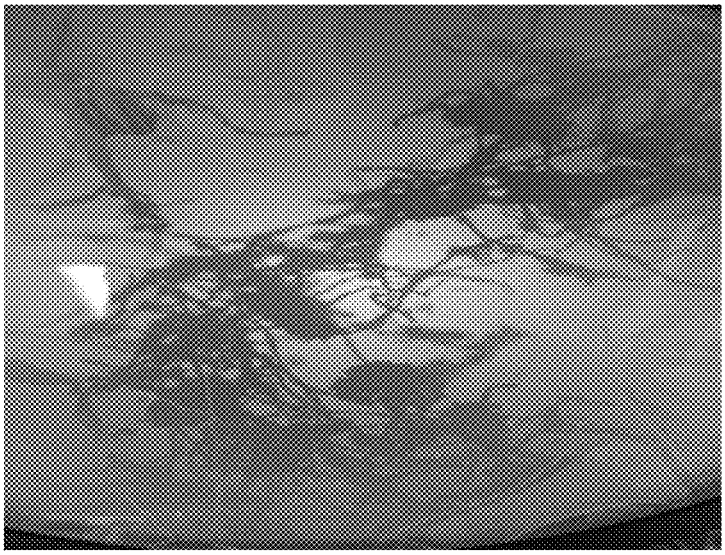
Figure 4:
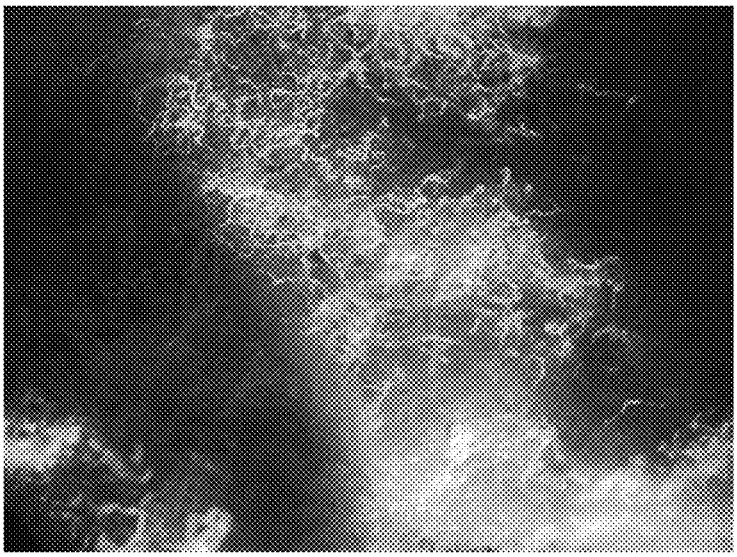
Figure 5:
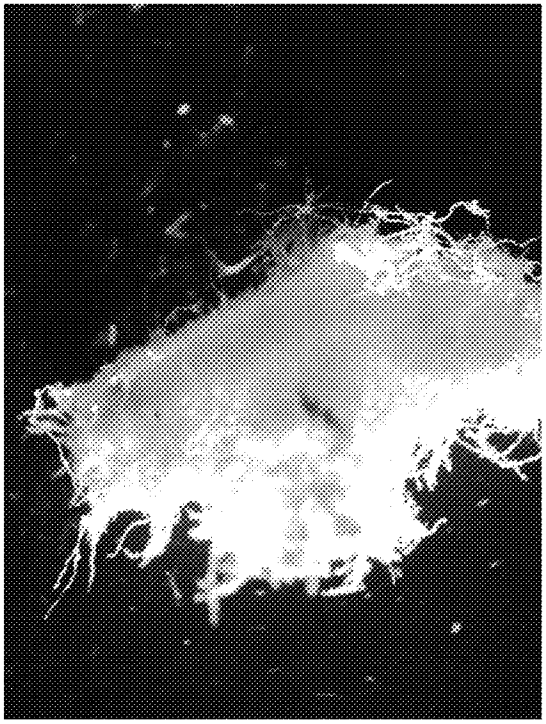

FIG. 1 is a perspective view of a pouched product embodiment, taken across the width of the product, showing an outer pouch filled with a composition of the present disclosure;

FIG. 2 is a photograph illustrating wheat straw dissolving pulp after drying;

FIGS. 3A and 3B are photographs illustrating wheat straw dissolving pulp after grinding;

FIG. 4 is a photograph illustrating hardwood dissolving pulp after grinding; and FIG. 5 is a photograph illustrating softwood dissolving pulp after grinding.

DETAILED DESCRIPTION

The present disclosure will now be described more fully hereinafter with reference to example embodiments thereof. These example embodiments are described so that this disclosure will be thorough and complete, and will fully convey the scope of the disclosure to those skilled in the art. Indeed, the disclosure may be embodied in many different forms and should not be construed as limited to the embodiments set forth herein; rather, these embodiments are provided so that this disclosure will satisfy applicable legal requirements. As used in this specification and the claims, the singular forms "a," "an," and "the" include plural referents unless the context clearly dictates otherwise. Reference to "dry weight percent" or "dry weight basis" refers to weight on the basis of dry ingredients (i.e., all ingredients except water). Reference to "wet weight" refers to the weight of the composition including water. Unless otherwise indicated, reference to "weight percent" of a composition reflects the total wet weight of the composition (i.e., including water).

The products as described herein comprise one or more fillers, and at least one additional component selected from the group consisting of active ingredients, flavorants, and combinations thereof. The relative amounts of the various components within the composition may vary, and typically are selected so as to provide the desired sensory and performance characteristics to the oral product. In certain embodiments, the oral products of the present disclosure are characterized by reduced density as compared to certain commercial products, which can provide both manufacturing and storage/transport cost savings, as well as improved environmental impact metrics generated from the lower weight, such as improved life cycle assessment (LCA)/reduced $CO_2$ footprint. The example individual components of the composition are described herein below.

Filler

Compositions as described herein include at least one filler. Such fillers may fulfill multiple functions, such as enhancing certain organoleptic properties such as texture and mouthfeel, enhancing cohesiveness or compressibility of the product, and the like. Generally, the fillers are particulate materials and/or fibrous materials, and are cellulose-based. For example, suitable fillers are any plant material or derivative thereof, including cellulose materials derived from such sources. Although the plant material source can be a tobacco material, it is advantageous to use non-tobacco plant sources. Plant material sources for use as filler can vary, and will include wood sources, agricultural residue sources (e.g., straw materials), annual plants and grasses including bast fiber sources (e.g., hemp, jute, or kenaf), or recycled plant material. Examples of cellulosic non-tobacco plant material include cereal grains (e.g., maize, oat, rice, barley, rye, buckwheat, and the like), sugar beet (e.g., FIBREX® brand filler available from International Fiber Corporation), bran fiber, bamboo fiber, wood pulp fiber (hardwood and softwood), cotton fiber, citrus pulp fiber, grass fiber, willow fiber, poplar fiber, cocoa fiber, derivatives thereof, and mixtures thereof. Additional examples of plant sources include abaca, bagasse, esparto, eucalyptus, flax, and sisal. Note that many of the above plant sources for filler materials can be used in a variety of forms, including processed plant material in the form of particulates or fibers, or in relatively unprocessed forms (e.g., whole straw), such as straw materials from common grains such as rye, wheat, oat, or barley.

Non-limiting examples of derivatives of non-tobacco plant material include starches (e.g., from potato, rye, oat, barley, wheat, rice, corn), natural cellulose, and modified cellulosic materials. Additional examples of potential fillers include maltodextrin, dextrose, calcium carbonate, calcium phosphate, lactose, mannitol, xylitol, and sorbitol. As described in more detail below, combinations of fillers can also be used.

"Starch" as used herein may refer to pure starch from any source, modified starch, or starch derivatives. Starch is present, typically in granular form, in almost all green plants and in various types of plant tissues and organs (e.g., seeds, leaves, rhizomes, roots, tubers, shoots, fruits, grains, and stems). Starch can vary in composition, as well as in granular shape and size. Often, starch from different sources has different chemical and physical characteristics. A specific starch can be selected for inclusion in the composition based on the ability of the starch material to impart a specific organoleptic property to composition. Starches derived from various sources can be used. For example, major sources of starch include cereal grains (e.g., rice, wheat, and maize) and root vegetables (e.g., potatoes and cassava). Other examples of sources of starch include acorns, arrowroot, arracacha, bananas, barley, beans (e.g., favas, lentils, mung beans, peas, chickpeas), breadfruit, buckwheat, canna, chestnuts, colacasia, katakuri, kudzu, malanga, millet, oats, oca, Polynesian arrowroot, sago, sorghum, sweet potato, quinoa, rye, tapioca, taro, tobacco, water chestnuts, and yams. Certain starches are modified starches. A modified starch has undergone one or more structural modifications, often designed to alter its high heat properties. Some starches have been developed by genetic modifications, and are considered to be "modified" starches. Other starches are obtained and subsequently modified. For example, modified starches can be starches that have been subjected to chemical reactions, such as esterification, etherification, oxidation, depolymerization (thinning) by acid catalysis or oxidation in the presence of base, bleaching, transglycosylation and depolymerization (e.g., dextrinization in the presence of a catalyst), cross-linking, enzyme treatment, acetylation, hydroxypropylation, and/or partial hydrolysis. Other starches are modified by heat treatments, such as pregelatinization, dextrinization, and/or cold water swelling processes. Certain modified starches include monostarch phosphate, distarch glycerol, distarch phosphate esterified with sodium trimetaphosphate, phosphate distarch phosphate, acetylated distarch phosphate, starch acetate esterified with acetic anhydride, starch acetate esterified with vinyl acetate, acetylated distarch adipate, acetylated distarch glycerol, hydroxypropyl starch, hydroxypropyl distarch glycerol, and starch sodium octenyl succinate.

In various embodiments, the plant-based filler material can be used in the form of a dissolving pulp or microcrystalline cellulose. "Dissolving pulp" (also sometimes referred to as a "dissolving grade pulp") as used herein may refer to a pulp material which has been treated such that the pulp has a high cellulose content (e.g., greater than 90% by weight). Typically, dissolving pulp can be produced by chemically treating a cellulosic plant material. Any of the plant sources noted herein can be used in a dissolving pulp form. The cellulosic plant material can be subjected to a sulfite process or a kraft process, as is known in the art, to remove water solubles, hemicelluloses, and lignin. Dissolving pulp typically have a high level of brightness, a relatively high chemical purity, and a low hemicellulose content.

To form a dissolving grade pulp, a plant material can be subjected to a plurality of operations, including chemical pulping a plant input to form a plant material pulp. Chemical pulping the plant material can comprise combining the plant material with a strong base (e.g., sodium hydroxide), and heating the plant material and the strong base. The resulting pulp material can also be subjected to bleaching to produce a dissolving grade pulp. By way of example, bleaching the plant material pulp can comprise chlorination of the pulp with a chlorine dioxide solution, and caustic extraction of the pulp with a second strong base (e.g., sodium hydroxide).

In certain embodiments, the dissolving grade pulp used in the present disclosure can comprise greater than about 85%, greater than about 88%, or greater than about 90% alpha cellulose by weight. Further, the dissolving grade pulp can define a brightness under International Organization for Standardization (ISO) conditions that is greater than about 80%, greater than about 83%, greater than about 85%, or between about 80% and 90%. Additionally, the degree of polymerization (DP) of the dissolving grade pulp can be less than about 900, less than about 800, or from about 100 to about 900.

Dissolving pulp can also be chemically treated to produce microcrystalline cellulose ("MCC"). Microcrystalline cellulose is purified, partially depolymerized cellulose. Cellulose is a naturally occurring polymer comprised of glucose units connected by a 1-4 beta glycosidic bond. Linear chains of cellulose are bundled together as microfibril in the walls of plant cells. Each microfibril defines a crystalline structure that is insoluble in water and resistant to reagents. However, microfibrils include amorphous regions with weaker internal bonding. The crystalline structure is isolated to produce microcrystalline cellulose. Microcrystalline cellulose can only be produced from alpha cellulose (also known as "chemical cellulose"), which is a highly refined, insoluble, relatively higher molecular weight cellulose from which sugars, pectin, and other soluble materials have been removed. With respect to other types of cellulose, beta cellulose is defined as a more degraded form of cellulose, with less crystalline regions. Further, gamma cellulose is defined as short-chain hemicelluloses. Thus, beta cellulose and gamma cellulose are typically removed from an input employed to produce microcrystalline cellulose.

In the production of microcrystalline cellulose, alpha cellulose can initially be shredded and then immersed in a hot bath of mineral acid to dissolve the amorphous regions of the microfibrils while leaving the microcrystalline structures intact. The microcrystalline structures can then be subjected to hydrolysis to break down long polymer chains until the degree of polymerization decreases and levels off to a desired extent. Chemicals and impurities can then be removed through water-washing followed by drying. The resulting microcrystalline cellulose can be embodied as a fine white crystallized powder in raw form. Methods for forming dissolving grade pulp and/or microcrystalline celluose from a plant material are set forth, for example, in U.S. Pat. No. 9,339,058 to Byrd, Jr. et al. and U.S. Pat. No. 10,774,472 to Sebastian, et al., both of which are incorporate herein by reference in their entirety. Dissolving grade pulp materials are commercially available from suppliers such as Domsjö Fabriker, Husum Pulp AB, and Södra. MCC materials are commercially available from suppliers such as DuPont de Nemours, Inc., Asahi Kasei Corporation, Sigachi Industries Limited, Accent Microcell Pvt. Ltd., and DFE Pharma GmbH & Co. KG.

The oral products of the present disclosure include at least one filler material characterized by a relatively low density. As noted above, the filler materials can be in the form of a dissolving grade pulp and/or an MCC material derived from a plant material, including any of the plant sources disclosed herein. Such low-density materials often have an untapped bulk density of about 150 g/L or less, about 125 g/L or less, about 100 g/L or less, about 75 g/L or less, or about 50 g/L or less. In some embodiments, such materials have an untapped bulk density in the range of about 15 g/L to about 150 g/L, or about 20 g/L to about 125 g/L, or about 30 g/L to about 100 g/L.

MCC is generally available as a highly crystalline powder or granular material with relatively uniform particle morphology. Thus, density properties of MCC are defined primary by the source of the plant material used to make the MCC. For example, MCC made from woody materials often have an untapped bulk density in the range of 300 to 360 g/L. However, for use as the low-density filler component of the present disclosure, there are MCC materials made from non-woody materials (e.g., maize or wheat straw or other plant sources noted herein). Such materials have an untapped bulk density range within the range noted above. In particular, such materials can have an untapped bulk density of about 150 g/L or less, about 125 g/L or less, about 100 g/L or less, or about 75 g/L or less (e.g., about 40 to about 120 g/L). As used herein, "non-woody" refers to a plant source other than hardwood or softwood sources. In various embodiments, the MCC is a particulate material having an average particle size in the range of about 25 to about 800 microns, about 50 microns to about 250 microns, about 180 microns to about 200 microns, about 75 microns to about 150 microns, or about 90 microns to about 100 microns.

Dissolving pulp materials are often available in sheet or flake form. It was surprisingly discovered that mechanically manipulating (e.g., tearing and/or grinding) a dissolving grade pulp can lower the density of the material. Without intending to be limited by theory, it is believed that mechanically grinding/tearing a dissolving grade pulp results in long irregular fiber shapes, which thereby decreases the bulk density of the material. Thus, grinding of dissolving pulp materials can produce advantageous low-density filler materials. In some embodiments, the dissolving pulp after grinding can have an untapped bulk density of about 100 g/L or less, about 75 g/L or less, about 50 g/L or less, or about 40 g/L or less (e.g., about 15 to about 50 g/L). As used herein, "grinding" refers to any mechanical force applied to the pulp material that is conducive to shredding or tearing the material into a more fibrous form with reduced bulk density.

In one aspect of the invention, a process for preparing a dissolving grade pulp material for use in oral products is provided. The method typically involves, if necessary, drying the dissolving grade pulp material to a moisture level conducive for grinding. For example, the moisture level can be less than about 10% by weight water prior to grinding (e.g., less than about 8% or less than about 6%). In some embodiments, the moisture content is in the range of about 1% to about 10%, about 2% to about 8%, or about 3% to about 6% by weight prior to grinding. The dried material is then subjected to a grinding operation, which can be performed using various types of grinding equipment known in the art, such as centrifugal grinding mills. In a centrifugal grinding mill, the feed material is subjected to impact and shearing forces created between the rotor and a fixed ring sieve. The level of grinding and the final size of the material varies based on the aperture size of the ring sieve (e.g., which can vary widely such as within range of 0.1 to 10 mm), residence time in the mill, and rotational speed used during grinding. In certain embodiments, the ring sieve aperture range is about 1 to about 3 mm, and the rotational speed is typically about 10,000 to about 18,000 rpm at a nominal power input of about 400-600 W. In certain embodiments, multiple grinding steps can be used such as a first grinding step at about 10,000 rpm and a second grinding step at about 15,000 rpm. The residence time in the mill is typically about 1 to about 10 seconds, or about 1 to about 5 seconds. The ground material is typically in a fibrous form with decreased bulk density and an increase in volume. After grinding, the fibrous material can be mixed with another filler as noted herein, and also mixed with at least one additional component such as active ingredients, flavorants, and combinations thereof, to form an oral composition adapted for oral use.

In various embodiments, the low-density filler material can be a wheat straw dissolving grade pulp. Wheat straw is an advantageous choice because it is an agricultural waste material, and therefore available in abundance without competing with food or conventional fiber production. Wheat straw dissolving grade pulp can be mechanically treated (e.g., subjected to grinding or tearing) to reach a final density in the range of about 30-50 g/L, or about 35-40 g/L.

In various embodiments, the low-density filler material can be a wood-derived dissolving grade pulp. As used herein, "wood" refers to the hard fibrous substance consisting basically of xylem that makes up the greater part of the stems, branches, and roots of trees or shrubs beneath the bark and is found to a limited extent in herbaceous plants. The wood used to product the dissolving grade pulp can be a hardwood or a softwood. As used herein, "hardwood" refers to wood that comes from flowering plants also known as "angiosperm." Example hardwoods include, but are not limited to, walnut, maple, oak, and birch. As used herein, "softwood" refers to wood that comes from gymnosperm trees which have needles and produce cones. Example softwoods include, but are not limited to, spruce, pine, cedar, yew, and hemlock. Hardwood dissolving grade pulp can be mechanically treated (e.g., subjected to grinding or tearing) to reach a final density in the range of about 20-50 g/L, or about 20-30 g/L. Softwood dissolving grade pulp can be mechanically treated (e.g., subjected to grinding or tearing) to reach a final density in the range of about 15-50 g/L, or about 20-30 g/L.

The low density filler component can form part of a blend of fillers or can comprise the entire filler content of the oral product. In certain embodiments, it has been found that using a combination of fillers can provide a product with a reduced weight without compromising sensory (e.g., taste, feel, etc.) characteristics of the oral product. Reducing the weight of the oral product can provide benefits such as lower material transport costs. Without intending to be limited by theory, it has been found that the weight of oral products of the present disclosure can be decreased by (i) at least partially replacing a relatively high density filler material with a lower density filler material; and/or (ii) at least partially replacing a particulate filler material with a fibrous filler material. The use of filler materials having a relatively low density reduces overall weight of a product unit of a given volumetric size. In addition, use of a filler material having the form of a fiber, as opposed to particulate, provides an increase in the bulking impact of the filler material, which also reduces overall weight for a product unit of a given volumetric size.

In some embodiments, the oral products of the present disclosure comprise a combination of fillers. The combination of fillers can include a first filler material and a second filler material, wherein the first filler material has a higher bulk density than the second filler material. In certain embodiments, the first filler material has an untapped bulk density of about 250 g/L or higher, about 300 g/L or higher, about 350 g/L or higher, about 400 g/L or higher, about 500 g/L or higher, or about 750 g/L or higher. In some embodiments, the first filler material has a bulk density in the range of about 250 g/L to about 1200 g/L, about 250 g/L to about 600 g/L, about 250 g/L to about 400 g/L, or about 250 g/L to about 350 g/L. In various embodiments, the second filler material (e.g., a plant-based cellulosic material such as a dissolving grade pulp and/or a non-wood MCC) has a bulk density as described above with respect to various low-density filler materials.

In various embodiments, the oral products described herein can include a first filler material in particulate form and a second filler material in fibrous form. In some embodiments, both the first filler material and the second filler material can be in particulate form. In certain embodiments, both the first filler material and the second filler material can be fibrous materials.

In some embodiments, the first, high-density filler material is a cellulose material or a cellulose derivative. In various embodiments, the first filler material is a non-tobacco cellulosic material. One particularly suitable first filler for use in the products described herein is microcrystalline cellulose ("MCC"), in particular, MCC derived from wood. The MCC may be synthetic or semi-synthetic, or it may be obtained entirely from natural celluloses. The MCC may be selected from the group consisting of AVICEL® grades PH-100, PH-102, PH-103, PH-105, PH-112, PH-113, PH-200, PH-300, PH-302, VIVACEL® grades 101, 102, 12, 20 and EMOCEL® grades 50M and 90M, and the like, and mixtures thereof. In various embodiments, the MCC is a particulate material having an average particle size in the range of about 25 to about 800 microns, about 50 microns to about 250 microns, about 75 microns to about 150 microns, or about 90 microns to about 100 microns.

In certain embodiments, the first, high-density filler material can be present in an amount of about 1% by weight to about 96% by weight, about 10% by weight to about 94% by weight, about 25% by weight to about 90% by weight, about 50% by weight to about 85% by weight, based on the total weight of fillers in the oral product. In some embodiments, the first, high-density filler material can be present in an amount of about 25% or higher, about 50% or higher, about 75% or higher, about 85% or higher, or about 90% or higher, based on the total weight of fillers in the oral product.

In certain embodiments, the second, low-density filler material can be present in an amount of about 2% by weight to about 99% by weight, about 4% by weight to about 90% by weight, about 10% by weight to about 75% by weight, or about 15% by weight to about 50% by weight, based on the total weight of fillers in the oral product. In some embodiments, the second, low-density filler material can be present in an amount of about 2% or higher, about 4% or higher, about 6% or higher, about 10% or higher, about 12% or higher, or about 15% or higher, based on the total weight of fillers in the oral product. In certain embodiments, the oral products of the present disclosure include only a single low-density filler material, or a combination of two or more low-density filler materials. For example, in some embodiments, the filler material is 100 weight percent of a dissolving grade pulp and/or a non-wood MCC material, based on the total weight of the filler within the oral product.

The total amount of filler(s) can vary, but is typically greater than about 20%, and up to about 75% of the composition by weight, based on the total weight of the composition. A typical range of filler (e.g., dissolving grade pulp/non-wood MCC alone or wood-based MCC in combination with dissolving grade pulp/non-wood MCC) within the composition can be from about 20 to about 75% by total weight of the composition, for example, from about 20, about 25, or about 30, to about 35, about 40, about 45, or about 50% by weight (e.g., about 20 to about 50%, or about 25 to about 45% by weight). In certain embodiments, the amount of filler is at least about 20% by weight, such as at least about 25%, or at least about 30%, or at least about 35%, or at least about 40%, based on the total weight of the composition. In certain embodiments, the amount of low-density filler component within the composition is about 2% or higher, about 3% or higher, about 4% or higher, or about 5% or higher, based on the total weight of the composition.

Active Ingredient

The composition as disclosed herein includes one or more active ingredients. As used herein, an "active ingredient" refers to one or more substances belonging to any of the following categories: API (active pharmaceutical substances), food additives, natural medicaments, and naturally occurring substances that can have an effect on humans. Example active ingredients include any ingredient known to impact one or more biological functions within the body, such as ingredients that furnish pharmacological activity or other direct effect in the diagnosis, cure, mitigation, treatment, or prevention of disease, or which affect the structure or any function of the body of humans (e.g., provide a stimulating action on the central nervous system, have an energizing effect, an antipyretic or analgesic action, or an otherwise useful effect on the body). In some embodiments, the active ingredient may be of the type generally referred to as dietary supplements, nutraceuticals, "phytochemicals" or "functional foods". These types of additives are sometimes defined in the art as encompassing substances typically available from naturally-occurring sources (e.g., botanical materials) that provide one or more advantageous biological effects (e.g., health promotion, disease prevention, or other medicinal properties), but are not classified or regulated as drugs.

Non-limiting examples of active ingredients include those falling in the categories of botanical ingredients, stimulants, amino acids, vitamins, antioxidants, nicotine components, pharmaceutical ingredients (e.g., nutraceutical and medicinal ingredients), and cannabinoids. The particular choice of active ingredients will vary depending upon the desired flavor, texture, and desired characteristics of the particular product.

The particular percentages of active ingredients present will vary depending upon the desired characteristics of the particular product. Typically, an active ingredient or combination thereof is present in a total concentration of at least about 0.001% by weight of the composition, such as in a range from about 0.001% to about 30%. In some embodiments, the active ingredient or combination of active ingredients is present in a concentration from about 0.1% w/w to about 10% by weight, such as, e.g., from about from about 0.5% w/w to about 20%, from about 1% to about 15%, from about 1% to about 10%, or from about 1% to about 5% by weight, based on the total weight of the composition. In some embodiments, the active ingredient or combination of active ingredients is present in a concentration of from about 0.001%, about 0.01%, about 0.1%, or about 1%, up to about 30% by weight, such as, e.g., from about from about 0.001%, about 0.002%, about 0.003%, about 0.004%, about 0.005%, about 0.006%, about 0.007%, about 0.008%, about 0.009%, about 0.01%, about 0.02%, about 0.03%, about 0.04%, about 0.05%, about 0.06%, about 0.07%, about 0.08%, about 0.09%, about 0.1%, about 0.2%, about 0.3%, about 0.4%, about 0.5% about 0.6%, about 0.7%, about 0.8%, or about 0.9%, to about 1%, about 2%, about 3%, about 4%, about 5%, about 6%, about 7%, about 8%, about 9%, about 10%, about 11%, about 12%, about 13%, about 14%, about 15%, about 16%, about 17%, about 18%, about 19%, about 20%, about 21%, about 22%, about 23%, about 24%, about 25%, about 26%, about 27%, about 28%, about 29%, or about 30% by weight, based on the total weight of the composition. Further suitable ranges for specific active ingredients are provided herein below.

Botanical

In some embodiments, the active ingredient comprises a botanical ingredient. As used herein, the term "botanical ingredient" or "botanical" refers to any plant material or fungal-derived material, including plant material in its natural form and plant material derived from natural plant materials, such as extracts or isolates from plant materials or treated plant materials (e.g., plant materials subjected to heat treatment, fermentation, bleaching, or other treatment processes capable of altering the physical and/or chemical nature of the material). For the purposes of the present disclosure, a "botanical" includes, but is not limited to, "herbal materials," which refer to seed-producing plants that do not develop persistent woody tissue and are often valued for their medicinal or sensory characteristics (e.g., teas or tisanes). Reference to botanical material as "non-tobacco" is intended to exclude tobacco materials (i.e., does not include any *Nicotiana* species).

When present, a botanical is typically at a concentration of from about 0.01% w/w to about 20% by weight, such as, e.g., from about from about 0.01% w/w, about 0.05%, about 0.1%, or about 0.5%, to about 1%, about 2%, about 3%, about 4%, about 5%, about 6%, about 7%, about 8%, about 9%, or about 10%, about 11%, about 12%, about 13%, about 14%, about 15%, about 16%, about 17%, about 18%, about 19%, or about 20% by weight, based on the total weight of the composition.

The botanical materials useful in the present disclosure may comprise, without limitation, any of the compounds and sources set forth herein, including mixtures thereof. Certain botanical materials of this type are sometimes referred to as dietary supplements, nutraceuticals, "phytochemicals" or "functional foods." Certain botanicals, as the plant material or an extract thereof, have found use in traditional herbal medicine, and are described further herein. Non-limiting examples of botanicals or botanical-derived materials include hemp, eucalyptus, rooibos, fennel, citrus, cloves, lavender, lemon balm, peppermint, chamomile, basil, rosemary, ginger, turmeric, green tea, white mulberry, cannabis, cocoa, ashwagandha, baobab, chlorophyll, cordyceps, damiana, ginseng, guarana, and maca. In some embodiments, the composition comprises green tea, turmeric, and white mulberry. In some embodiments, the composition comprises lemon balm, such as lemon balm extract.

Ashwagandha (*Withania somnifera*) is a plant in the Solanaceae (nightshade) family. As an herb, Ashwagandha has found use in the Indian Ayurvedic system of medicine, where it is also known as "Indian Winter cherry" or "Indian Ginseng." In some embodiments, the active ingredient comprises ashwagandha.

Baobab is the common name of a family of deciduous trees of the genus *Adansonia*. The fruit pulp and seeds of the Baobab are consumed, generally after drying, as a food or nutritional supplement. In some embodiments, the active ingredient comprises baobab.

Chlorophyll is any of several related green pigments found in the mesosomes of cyanobacteria, as well as in the chloroplasts of algae and plants. Chlorophyll has been used as a food additive (colorant) and a nutritional supplement. Chlorophyll may be provided either from native plant materials (e.g., botanicals) or in an extract or dried powder form. In some embodiments, the active ingredient comprises chlorophyll.

Cordyceps is a diverse genus of ascomycete (sac) fungi which are abundant in humid temperate and tropical forests. Members of the cordyceps family are used extensively in traditional Chinese medicine. In some embodiments, the active ingredient comprises cordyceps.

Damiana is a small, woody shrub of the family Passifloraceae. It is native to southern Texas, Central America, Mexico, South America, and the Caribbean. Damiana produces small, aromatic flowers, followed by fruits that taste similar to figs. The extract from damiana has been found to suppress aromatase activity, including the isolated compounds pinocembrin and acacetin. In some embodiments, the active ingredient comprises damiana.

Guarana is a climbing plant in the family Sapindaceae, native to the Amazon basin. The seeds from its fruit, which are about the size of a coffee bean, have a high concentration of caffeine and, consequently, stimulant activity. In some embodiments, the active ingredient comprises guarana. In some embodiments, the active ingredient comprises guarana, honey, and ashwagandha.

Ginseng is the root of plants of the genus *Panax*, which are characterized by the presence of unique steroid saponin phytochemicals (ginsenosides) and gintonin. Ginseng finds use as a dietary supplement in energy drinks or herbal teas, and in traditional medicine. Cultivated species include Korean ginseng (*P. ginseng*), South China ginseng (*P. notoginseng*), and American ginseng (*P. quinquefolius*). American ginseng and Korean ginseng vary in the type and quantity of various ginsenosides present. In some embodiments, the active ingredient comprises ginseng. In some embodiments, the ginseng is American ginseng or Korean ginseng. In specific embodiments, the active ingredient comprises Korean ginseng.

Lemon balm (*Melissa officinalis*) is a mildly lemon-scented herb from the same family as mint (Lamiaceae). The herb is native to Europe, North Africa, and West Asia. The tea of lemon balm, as well as the essential oil and the extract, are used in traditional and alternative medicine. In some embodiments, the active ingredient comprises lemon balm extract.

Maca is a plant that grows in central Peru in the high plateaus of the Andes Mountains. It is a relative of the radish, and has an odor similar to butterscotch. Maca has been used in traditional (e.g., Chinese) medicine. In some embodiments, the active ingredient comprises maca.

Stimulants

In some embodiments, the active ingredient comprises one or more stimulants. As used herein, the term "stimulant" refers to a material that increases activity of the central nervous system and/or the body, for example, enhancing focus, cognition, vigor, mood, alertness, and the like. Non-limiting examples of stimulants include caffeine, theacrine, theobromine, and theophylline. Theacrine (1,3,7,9-tetramethyluric acid) is a purine alkaloid which is structurally related to caffeine, and possesses stimulant, analgesic, and anti-inflammatory effects. Present stimulants may be natural, naturally derived, or wholly synthetic. For example, certain botanical materials (guarana, tea, coffee, cocoa, and the like) may possess a stimulant effect by virtue of the presence of e.g., caffeine or related alkaloids, and accordingly are "natural" stimulants. By "naturally derived" is meant the stimulant (e.g., caffeine, theacrine) is in a purified form, outside its natural (e.g., botanical) matrix. For example, caffeine can be obtained by extraction and purification from botanical sources (e.g., tea). By "wholly synthetic", it is meant that the stimulant has been obtained by chemical synthesis.

When present, a stimulant or combination of stimulants (e.g., caffeine, theacrine, and combinations thereof) is typically at a concentration of from about 0.1% w/w to about 15% by weight, such as, e.g., from about from about 0.1% w/w, about 0.2%, about 0.3%, about 0.4%, about 0.5% about 0.6%, about 0.7%, about 0.8%, or about 0.9%, to about 1%, about 2%, about 3%, about 4%, about 5%, about 6%, about 7%, about 8%, about 9%, about 10%, about 11%, about 12%, about 13%, about 14%, or about 15% by weight, based on the total weight of the composition.

In some embodiments, the active ingredient comprises caffeine. In some embodiments, the active ingredient comprises theacrine. In some embodiments, the active ingredient comprises a combination of caffeine and theacrine.

Amino Acids

In some embodiments, the active ingredient comprises an amino acid. As used herein, the term "amino acid" refers to an organic compound that contains amine (—$NH_2$) and carboxyl (—COOH) or sulfonic acid ($SO_3H$) functional groups, along with a side chain (R group), which is specific to each amino acid. Amino acids may be proteinogenic or non-proteinogenic. By "proteinogenic" is meant that the amino acid is one of the twenty naturally occurring amino acids found in proteins. The proteinogenic amino acids include alanine, arginine, asparagine, aspartic acid, cysteine, glutamine, glutamic acid, glycine, histidine, isoleucine, leucine, lysine, methionine, phenylalanine, proline, serine, threonine, tryptophan, tyrosine, and valine. By "non-proteinogenic" is meant that either the amino acid is not found naturally in protein, or is not directly produced by cellular machinery (e.g., is the product of post-translational modification). Non-limiting examples of non-proteinogenic amino acids include gamma-aminobutyric acid (GABA), taurine (2-aminoethanesulfonic acid), theanine (L-γ-glutamylethylamide), hydroxyproline, and beta-alanine.

When present, an amino acid or combination of amino acids (e.g., taurine, theanine, GABA, and combinations thereof) is typically at a concentration of from about 0.01% w/w to about 20% by weight, such as, e.g., from about from about 0.01, about 0.02, about 0.03, about 0.04, about 0.05, about 0.06, about 0.07, about 0.08, about 0.09, 0.1% w/w, about 0.2%, about 0.3%, about 0.4%, about 0.5% about 0.6%, about 0.7%, about 0.8%, or about 0.9%, to about 1%, about 2%, about 3%, about 4%, about 5%, about 6%, about 7%, about 8%, about 9%, about 10%, about 11%, about 12%, about 13%, about 14%, about 15%, about 16%, about 17%, about 18%, about 19%, or about 20% by weight, based on the total weight of the composition.

In some embodiments, the amino acid is taurine, theanine, phenylalanine, tyrosine, tryptophan, or a combination thereof. In some embodiments, the amino acid is taurine. In some embodiments, the active ingredient comprises a combination of taurine and caffeine. In some embodiments, the active ingredient comprises a combination of taurine, caffeine, and guarana. In some embodiments, the active ingredient comprises a combination of taurine, maca, and cordyceps. In some embodiments, the active ingredient comprises a combination of theanine and caffeine. In some embodiments, the active ingredient comprises a combination of theanine and GABA. In some embodiments, the active ingredient comprises theanine in an amount by weight of from about 5 to about 10%, and GABA in an amount by weight of from about 5 to about 10%, based on the total weight of the composition. In some embodiments, the active ingredient comprises a combination of theanine, GABA, and lemon balm.

Vitamins

In some embodiments, the active ingredient comprises a vitamin or combination of vitamins. As used herein, the term "vitamin" refers to an organic molecule (or related set of molecules) that is an essential micronutrient needed for the proper functioning of metabolism in a mammal. There are thirteen vitamins required by human metabolism, which are: vitamin A (as all-trans-retinol, all-trans-retinyl-esters, as well as all-trans-beta-carotene and other provitamin A carotenoids), vitamin B1 (thiamine), vitamin B2 (riboflavin), vitamin B3 (niacin), vitamin B5 (pantothenic acid), vitamin B6 (pyridoxine), vitamin B7 (biotin), vitamin B9 (folic acid or folate), vitamin B12 (cobalamins), vitamin C (ascorbic acid), vitamin D (calciferols), vitamin E (tocopherols and tocotrienols), and vitamin K (quinones).

When present, a vitamin or combination of vitamins (e.g., vitamin B6, vitamin B12, vitamin E, vitamin C, or a combination thereof) is typically at a concentration of from about 0.01% w/w to about 1% by weight, such as, e.g., from about from about 0.01%, about 0.02%, about 0.03%, about 0.04%, about 0.05%, about 0.06%, about 0.07%, about 0.08%, about 0.09%, or about 0.1% w/w, to about 0.2%, about 0.3%, about 0.4%, about 0.5% about 0.6%, about 0.7%, about 0.8%, about 0.9%, or about 1% by weight, based on the total weight of the composition.

In some embodiments, the vitamin is vitamin B6, vitamin B12, vitamin E, vitamin C, or a combination thereof. In some embodiments, the active ingredient comprises a combination of vitamin B6, caffeine, and theanine. In some embodiments, the active ingredient comprises vitamin B6, vitamin B12, and taurine. In some embodiments, the active ingredient comprises a combination of vitamin B6, vitamin B12, ginseng, and theanine. In some embodiments, the active ingredient comprises a combination of vitamin C, baobab, and chlorophyll.

Antioxidants

In some embodiments, the active ingredient comprises one or more antioxidants. As used herein, the term "antioxidant" refers to a substance which prevents or suppresses oxidation by terminating free radical reactions, and may delay or prevent some types of cellular damage. Antioxidants may be naturally occurring or synthetic. Naturally occurring antioxidants include those found in foods and botanical materials. Non-limiting examples of antioxidants include certain botanical materials, vitamins, polyphenols, and phenol derivatives.

Examples of botanical materials which are associated with antioxidant characteristics include without limitation acai berry, alfalfa, allspice, annatto seed, apricot oil, basil, bee balm, wild bergamot, black pepper, blueberries, borage seed oil, bugleweed, cacao, calamus root, catnip, catuaba, cayenne pepper, chaga mushroom, chervil, cinnamon, dark chocolate, potato peel, grape seed, ginseng, gingko biloba, Saint John's Wort, saw palmetto, green tea, black tea, black cohosh, cayenne, chamomile, cloves, cocoa powder, cranberry, dandelion, grapefruit, honeybush, echinacea, garlic, evening primrose, feverfew, ginger, goldenseal, hawthorn, hibiscus flower, jiaogulan, kava, lavender, licorice, marjoram, milk thistle, mints (menthe), oolong tea, beet root, orange, oregano, papaya, pennyroyal, peppermint, red clover, rooibos (red or green), rosehip, rosemary, sage, clary sage, savory, spearmint, spirulina, slippery elm bark, sorghum bran hi-tannin, sorghum grain hi-tannin, sumac bran, comfrey leaf and root, goji berries, gutu kola, thyme, turmeric, uva ursi, valerian, wild yam root, wintergreen, yacon root, yellow dock, *Yerba mate, Yerba santa, Bacopa monniera, Withania somnifera*, Lion's mane, and *Silybum marianum*. Such botanical materials may be provided in fresh or dry form, essential oils, or may be in the form of an extracts. The botanical materials (as well as their extracts) often include compounds from various classes known to provide antioxidant effects, such as minerals, vitamins, isoflavones, phytoesterols, allyl sulfides, dithiolthiones, isothiocyanates, indoles, lignans, flavonoids, polyphenols, and carotenoids. Examples of compounds found in botanical extracts or oils include ascorbic acid, peanut endocarb, resveratrol, sulforaphane, beta-carotene, lycopene, lutein, co-enzyme Q, carnitine, quercetin, kaempferol, and the like. See, e.g., Santhosh et al., Phytomedicine, 12(2005) 216-220, which is incorporated herein by reference.

Non-limiting examples of other suitable antioxidants include citric acid, Vitamin E or a derivative thereof, a tocopherol, epicatechol, epigallocatechol, epigallocatechol gallate, erythorbic acid, sodium erythorbate, 4-hexylresorcinol, theaflavin, theaflavin monogallate A or B, theaflavin digallate, phenolic acids, glycosides, quercitrin, isoquercitrin, hyperoside, polyphenols, catechols, resveratrols, oleuropein, butylated hydroxyanisole (BHA), butylated hydroxytoluene (BHT), tertiary butylhydroquinone (TBHQ), and combinations thereof. In some embodiments, the antioxidant is Vitamin E or a derivative thereof, a flavonoid, a polyphenol, a carotenoid, or a combination thereof.

When present, an antioxidant is typically at a concentration of from about 0.001% w/w to about 10% by weight, such as, e.g., from about from about 0.001%, about 0.005%, about 0.01% w/w, about 0.05%, about 0.1%, or about 0.5%, to about 1%, about 2%, about 3%, about 4%, about 5%, about 6%, about 7%, about 8%, about 9%, or about 10%, based on the total weight of the composition.

Nicotine Component

In certain embodiments, the active ingredient comprises a nicotine component. By "nicotine component" is meant any suitable form of nicotine (e.g., free base or salt) for providing oral absorption of at least a portion of the nicotine present. Typically, the nicotine component is selected from the group consisting of nicotine free base and a nicotine salt. In some embodiments, the nicotine component is nicotine in its free base form, which easily can be adsorbed in for example, a microcrystalline cellulose material to form a microcrystalline cellulose-nicotine carrier complex. See, for example, the discussion of nicotine in free base form in US Pat. Pub. No. 2004/0191322 to Hansson, which is incorporated herein by reference.

In some embodiments, at least a portion of the nicotine component can be employed in the form of a salt. Salts of nicotine can be provided using the types of ingredients and techniques set forth in U.S. Pat. No. 2,033,909 to Cox et al. and Perfetti, *Beitrage Tabakforschung Int.,* 12:43-54 (1983), which are incorporated herein by reference. Additionally, salts of nicotine are available from sources such as Pfaltz and Bauer, Inc. and K&K Laboratories, Division of ICN Biochemicals, Inc. Typically, the nicotine component is selected from the group consisting of nicotine free base, a nicotine salt such as hydrochloride, dihydrochloride, monotartrate, bitartrate, sulfate, salicylate, and nicotine zinc chloride.

In some embodiments, at least a portion of the nicotine can be in the form of a resin complex of nicotine, where nicotine is bound in an ion-exchange resin, such as nicotine polacrilex, which is nicotine bound to, for example, a polymethacrilic acid, such as Amberlite IRP64, Purolite C115HMR, or Doshion P551. See, for example, U.S. Pat. No. 3,901,248 to Lichtneckert et al., which is incorporated herein by reference. Another example is a nicotine-polyacrylic carbomer complex, such as with Carbopol 974P. In some embodiments, nicotine may be present in the form of a nicotine polyacrylic complex.

Typically, the nicotine component (calculated as the free base) when present, is in a concentration of at least about 0.001% by weight of the composition, such as in a range from about 0.001% to about 10%. In some embodiments, the nicotine component is present in a concentration from about 0.1% w/w to about 10% by weight, such as, e.g., from about from about 0.1% w/w, about 0.2%, about 0.3%, about 0.4%, about 0.5% about 0.6%, about 0.7%, about 0.8%, or about 0.9%, to about 1%, about 2%, about 3%, about 4%, about 5%, about 6%, about 7%, about 8%, about 9%, or about 10% by weight, calculated as the free base and based on the total weight of the composition. In some embodiments, the nicotine component is present in a concentration from about 0.1% w/w to about 3% by weight, such as, e.g., from about from about 0.1% w/w to about 2.5%, from about 0.1% to about 2.0%, from about 0.1% to about 1.5%, or from about 0.1% to about 1% by weight, calculated as the free base and based on the total weight of the composition.

In some embodiments, the products or compositions of the disclosure can be characterized as completely free or substantially free of any nicotine component (e.g., any embodiment as disclosed herein may be completely or substantially free of any nicotine component). By "substantially free" is meant that no nicotine has been intentionally added, beyond trace amounts that may be naturally present in e.g., a botanical material. For example, certain embodiments can be characterized as having less than 0.001% by weight of nicotine, or less than 0.0001%, or even 0% by weight of nicotine, calculated as the free base.

In some embodiments, the active ingredient comprises a nicotine component (e.g., any product or composition of the disclosure, in addition to comprising any active ingredient or combination of active ingredients as disclosed herein, may further comprise a nicotine component). In some embodiments, the active ingredient comprises a combination of nicotine and ginseng. In some embodiments, the active ingredient comprises a combination of nicotine and caffeine. In some embodiments, the active ingredient comprises a combination of nicotine and guarana.

Cannabinoids

In some embodiments, the active ingredient comprises one or more cannabinoids. As used herein, the term "cannabinoid" refers to a class of diverse natural or synthetic chemical compounds that acts on cannabinoid receptors (i.e., CB1 and CB2) in cells that alter neurotransmitter release in the brain. Cannabinoids are cyclic molecules exhibiting particular properties such as the ability to easily cross the blood-brain barrier. Cannabinoids may be naturally occurring (Phytocannabinoids) from plants such as cannabis, (endocannabinoids) from animals, or artificially manufactured (synthetic cannabinoids). Cannabis species express at least 85 different phytocannabinoids, and these may be divided into subclasses, including cannabigerols, cannabichromenes, cannabidiols, tetrahydrocannabinols, cannabinols and cannabinodiols, and other cannabinoids, such as cannabigerol (CBG), cannabichromene (CBC), cannabidiol (CBD), tetrahydrocannabinol (THC), cannabinol (CBN) and cannabinodiol (CBDL), cannabicyclol (CBL), cannabivarin (CBV), tetrahydrocannabivarin (THCV), cannabidivarin (CBDV), cannabichromevarin (CBCV), cannabigerovarin (CBGV), cannabigerol monomethyl ether (CBGM), cannabinerolic acid, cannabidiolic acid (CBDA), Cannabinol propyl variant (CBNV), cannabitriol (CBO), tetrahydrocannabmolic acid (THCA), and tetrahydrocannabivarinic acid (THCV A).

In some embodiments, the cannabinoid is selected from the group consisting of cannabigerol (CBG), cannabichromene (CBC), cannabidiol (CBD), tetrahydrocannabinol (THC), cannabinol (CBN) and cannabinodiol (CBDL), cannabicyclol (CBL), cannabivarin (CBV), tetrahydrocannabivarin (THCV), cannabidivarin (CBDV), cannabichromevarin (CBCV), cannabigerovarin (CBGV), cannabigerol monomethyl ether (CBGM), cannabinerolic acid, cannabidiolic acid (CBDA), Cannabinol propyl variant (CBNV), cannabitriol (CBO), tetrahydrocannabmolic acid (THCA), tetrahydrocannabivarinic acid (THCV A), and mixtures thereof. In some embodiments, the cannabinoid comprises at least tetrahydrocannabinol (THC). In some embodiments, the cannabinoid is tetrahydrocannabinol (THC). In some embodiments, the cannabinoid comprises at least cannabidiol (CBD). In some embodiments, the cannabinoid is cannabidiol (CBD). In some embodiments, the CBD is synthetic CBD. Notably, CBD has a logP value of about 6.5, making it insoluble in an aqueous environment (e.g., saliva).

In some embodiments, the cannabinoid (e.g., CBD) is added to the oral product in the form of an isolate. An isolate is an extract from a plant, such as cannabis, where the active material of interest (in this case the cannabinoid, such as CBD) is present in a high degree of purity, for example greater than 95%, greater than 96%, greater than 97%, greater than 98%, or around 99% purity.

In some embodiments, the cannabinoid is an isolate of CBD in a high degree of purity, and the amount of any other cannabinoid in the oral product is no greater than about 1% by weight of the oral product, such as no greater than about 0.5% by weight of the oral product, such as no greater than about 0.1% by weight of the oral product, such as no greater than about 0.01% by weight of the oral product.

The choice of cannabinoid and the particular percentages thereof which may be present within the disclosed oral product will vary depending upon the desired flavor, texture, and other characteristics of the oral product.

Alternatively, or in addition to the cannabinoid, the active agent may include a cannabimimetic, which is a class of compounds derived from plants other than cannabis that have biological effects on the endocannabinoid system similar to cannabinoids. Examples include yangonin, alpha-amyrin or beta-amyrin (also classified as terpenes), cyanidin, curcumin (tumeric), catechin, quercetin, salvinorin A, N-acylethanolamines, and N-alkylamide lipids. Such compounds can be used in the same amounts and ratios noted herein for cannabinoids.

When present, a cannabinoid (e.g., CBD) is typically in a concentration of at least about 0.1% by weight of the effervescent composition, such as in a range from about 0.1% to about 30%, such as, e.g., from about from about 0.1%, about 0.2%, about 0.3%, about 0.4%, about 0.5% about 0.6%, about 0.7%, about 0.8%, or about 0.9%, to about 1%, about 2%, about 3%, about 4%, about 5%, about 6%, about 7%, about 8%, about 9%, about 10%, about 15%, about 20%, or about 30% by weight, based on the total weight of the effervescent composition.

Terpenes

Active ingredients suitable for use in the present disclosure can also be classified as terpenes, many of which are associated with biological effects, such as calming effects. Terpenes are understood to have the general formula of $(C_5H_8)_n$ and include monoterpenes, sesquiterpenes, and diterpenes. Terpenes can be acyclic, monocyclic or bicyclic in structure. Some terpenes provide an entourage effect when used in combination with cannabinoids or cannabimimetics. Examples include beta-caryophyllene, linalool, limonene, beta-citronellol, linalyl acetate, pinene (alpha or beta), geraniol, carvone, eucalyptol, menthone, iso-menthone, piperitone, myrcene, beta-bourbonene, and germacrene, which may be used singly or in combination.

In some embodiments, the terpene is a terpene derivable from a phytocannabinoid producing plant, such as a plant from the stain of the *Cannabis sativa* species, such as hemp. Suitable terpenes in this regard include so-called "C10" terpenes, which are those terpenes comprising 10 carbon atoms, and so-called "C15" terpenes, which are those terpenes comprising 15 carbon atoms. In some embodiments, the active ingredient comprises more than one terpene. For example, the active ingredient may comprise one, two, three, four, five, six, seven, eight, nine, ten or more terpenes as defined herein. In some embodiments, the terpene is selected from pinene (alpha and beta), geraniol, linalool, limonene, carvone, eucalyptol, menthone, iso-menthone, piperitone, myrcene, beta-bourbonene, germacrene and mixtures thereof.

Pharmaceutical Ingredients

In some embodiments, the active ingredient comprises a pharmaceutical ingredient. The pharmaceutical ingredient can be any known agent adapted for therapeutic, prophylactic, or diagnostic use. These can include, for example, synthetic organic compounds, proteins and peptides, polysaccharides and other sugars, lipids, inorganic compounds (e.g., magnesium, selenium, zinc, nitrate), neurotransmitters or precursors thereof (e.g., serotonin, 5-hydroxy-tryptophan, oxitriptan, acetylcholine, dopamine, melatonin), and nucleic acid sequences, having therapeutic, prophylactic, or diagnostic activity. Non-limiting examples of pharmaceutical ingredients include analgesics and antipyretics (e.g., acetylsalicylic acid, acetaminophen, 3-(4-isobutylphenyl)propanoic acid), phosphatidylserine, myoinositol, docosahexaenoic acid (DHA, Omega-3), arachidonic acid (AA, Omega-6), S-adenosylmethionine (SAM), beta-hydroxy-beta-methylbutyrate (HMB), citicoline (cytidine-5'-diphosphate-choline), and cotinine.

The amount of pharmaceutical ingredient may vary. For example, when present, a pharmaceutical ingredient is typically at a concentration of from about 0.001% w/w to about 10% by weight, such as, e.g., from about from about 0.01%, about 0.02%, about 0.03%, about 0.04%, about 0.05%, about 0.06%, about 0.07%, about 0.08%, about 0.09%, about 0.1% w/w, about 0.2%, about 0.3%, about 0.4%, about 0.5% about 0.6%, about 0.7%, about 0.8%, about 0.9%, or about 1%, to about 2%, about 3%, about 4%, about 5%, about 6%, about 7%, about 8%, about 9%, or about 10% by weight, based on the total weight of the composition.

Bleached Active Ingredient

In some embodiments, the oral product comprises an active ingredient as disclosed herein, wherein the active ingredient is characterized as bleached. Such a bleached active ingredient may be desirable e.g., to prevent tooth discoloration during use of the oral product, or so that any residue remaining in the mouth of the user after use of the product is less visible, and is less likely to cause staining of fibrous materials, such as clothing, that may contact the residue. By "bleached" active ingredient is meant an active ingredient (e.g., a botanical material or derivative thereof), which, in its natural state possesses a color, and which has been treated to reduce or eliminate the color. By "color" is meant the characteristic of human visual perception described through color categories, with names such as red, blue, yellow (primary colors) or brown, orange, green, purple, and the like, resulting from combinations of primary colors. This perception of color derives from the stimulation of cone cells in the human eye by electromagnetic radiation in the visible spectrum, associated with objects through the wavelength of the light that is reflected from them. This reflection is governed by the object's physical properties such as e.g., absorption and emission spectra across the electromagnetic spectrum.

Certain active ingredients, by virtue of naturally occurring chemical compounds therein which reflect light in the visible range of the electromagnetic spectrum, impart a color to the active ingredient (e.g., chlorophyll or pigment decomposition products in certain botanical materials, responsible for green color and brown colors, respectively). Such chemical compounds, or a portion thereof, which are responsible for the color of the active ingredient, may be chemically altered or removed by various treatments. In some embodiments, the treatment is effective to eliminate at least 70% of the chemicals present in the active ingredient having maximum transmission of wavelengths in the visible range of the electromagnetic spectrum, based on the weight of the naturally occurring compounds. For example, such treatment may be effective to remove 70%, 80%, 90%, 95%, 99%, or even 100% of the naturally occurring compounds responsible for the visible color of the active ingredient.

In some embodiments, the treatment for bleaching (i.e., altering or removing colored chemical compounds from the active ingredient) includes extraction, chemical bleaching, or a combination thereof. One particularly suitable extraction method is supercritical carbon dioxide ($CO_2$) extraction. Methods of chemical bleaching of e.g., botanical materials, including tobacco, are known, and include as non-limiting examples, treatment with hydrogen peroxide, ozone, or other oxidizing agents. For example, bleached active ingredients (e.g., a bleached botanical or tobacco material) may be produced by various whitening methods using various bleaching or oxidizing agents. Example oxidizing agents include peroxides (e.g., hydrogen peroxide), chlorite salts, chlorate salts, perchlorate salts, hypochlorite salts, ozone, ammonia, potassium permanganate, and combinations thereof. Oxidation catalysts can be used. Example oxidation catalysts are titanium dioxide, manganese dioxide, and combinations thereof.

Methods of bleaching known for bleaching tobacco may be applied to the present active ingredients. Processes for treating tobacco with bleaching agents are discussed, for example, in U.S. Pat. No. 787,611 to Daniels, Jr.; U.S. Pat.

No. 1,086,306 to Oelenheinz; U.S. Pat. No. 1,437,095 to Delling; U.S. Pat. No. 1,757,477 to Rosenhoch; U.S. Pat. No. 2,122,421 to Hawkinson; U.S. Pat. No. 2,148,147 to Baier; U.S. Pat. No. 2,170,107 to Baier; U.S. Pat. No. 2,274,649 to Baier; U.S. Pat. No. 2,770,239 to Prats et al.; U.S. Pat. No. 3,612,065 to Rosen; U.S. Pat. No. 3,851,653 to Rosen; U.S. Pat. No. 3,889,689 to Rosen; U.S. Pat. No. 3,943,940 to Minami; U.S. Pat. No. 3,943,945 to Rosen; U.S. Pat. No. 4,143,666 to Rainer; U.S. Pat. No. 4,194,514 to Campbell; U.S. Pat. Nos. 4,366,823, 4,366,824, and 4,388,933 to Rainer et al.; U.S. Pat. No. 4,641,667 to Schmekel et al.; U.S. Pat. No. 5,713,376 to Berger; U.S. Pat. No. 9,339,058 to Byrd Jr. et al.; U.S. Pat. No. 9,420,825 to Beeson et al.; and U.S. Pat. No. 9,950,858 to Byrd Jr. et al.; as well as in US Pat. App. Pub. Nos. 2012/0067361 to Bjorkholm et al.; 2016/0073686 to Crooks; 2017/0020183 to Bjorkholm; and 2017/0112183 to Bjorkholm, and in PCT Publ. Appl. Nos. WO1996/031255 to Giolvas and WO2018/083114 to Bjorkholm, all of which are incorporated herein by reference.

In some embodiments, the bleached active agent, or the composition or product comprising the bleached active agent, can have an ISO brightness of at least about 50%, at least about 60%, at least about 65%, at least about 70%, at least about 75%, or at least about 80%. In some embodiments, the bleached active agent or the composition or product comprising the bleached active agent, can have an ISO brightness in the range of about 50% to about 90%, about 55% to about 75%, or about 60% to about 70%. ISO brightness can be measured according to ISO 3688:1999 or ISO 2470-1:2016.

In some embodiments, the bleached active agent can be characterized as lightened in color (e.g., "whitened") in comparison to an untreated active agent. White colors are often defined with reference to the International Commission on Illumination's (CIE's) chromaticity diagram. The bleached active agent or the composition or product comprising the bleached active agent, can, in certain embodiments, be characterized as closer on the chromaticity diagram to pure white than an untreated active agent or composition or product comprising an untreated active agent.

Whiteness values of bleached active ingredients, compositions, and pouched products comprising such ingredients, may be determined according to the Commission Internationale de l'Eclairage (CIE) model, for example, with a hand-held color meter, relative to a control product (See "Precise Color Communication; Color Control from Perception to Instrumentation," Konica Minolta, 2007; http://konicaminolta.com/instruments/about/network, which is incorporated herein by reference). Discoloration from white may be evaluated by the E313 Whiteness Index according to ASTM method E313, using the formula WI=(3.388Z−3Y, where Y and Z are the CIE tri-stimulus values, and measured by a hand-held meter.

Water

The moisture content (e.g., water content) of the composition, prior to use by a consumer of the product, may vary according to the desired properties. Typically, the composition, as present within e.g., a pouched product, prior to insertion into the mouth of the user, is less than about 60% by weight of water, and generally is from about 1 to about 60% by weight of water, for example, from about 5 to about 55%, about 10 to about 50%, about 20 to about 45%, about 25 to about 40%, or about 30 to about 60% water by weight, including water amounts of at least about 5% by weight, at least about 10% by weight, at least about 15% by weight, at least about 20% by weight, at least about 30% by weight, and at least about 40% by weight.

Salts

In some embodiments, the composition comprises a salt (e.g., an alkali metal salt), typically employed in an amount sufficient to provide desired sensory attributes to the composition. Non-limiting examples of suitable salts include sodium chloride, potassium chloride, ammonium chloride, flour salt, sodium acetate, sodium citrate, and the like. In some embodiments, the salt is sodium chloride, ammonium chloride, or a combination thereof.

When present, a representative amount of salt is about 0.5% by weight or more, about 1.0% by weight or more, or about 1.5% by weight or more, but will typically make up about 10% or less of the total weight of the composition, or about 7.5% or less, or about 5% or less (e.g., from about 0.5 to about 5% by weight).

Sweeteners

In order to improve the sensory properties of the composition according to the disclosure, one or more sweeteners may be added. The sweeteners can be any sweetener or combination of sweeteners, in natural or artificial form, or as a combination of natural and artificial sweeteners. Examples of natural sweeteners include fructose, sucrose, glucose, maltose, mannose, galactose, lactose, stevia, honey, and the like. Examples of artificial sweeteners include sucralose, isomaltulose, maltodextrin, saccharin, aspartame, acesulfame K, neotame, and the like. In some embodiments, the sweetener comprises one or more sugar alcohols. Sugar alcohols are polyols derived from monosaccharides or disaccharides that have a partially or fully hydrogenated form. Sugar alcohols have, for example, about 4 to about 20 carbon atoms and include erythritol, arabitol, ribitol, isomalt, maltitol, dulcitol, iditol, mannitol, xylitol, lactitol, sorbitol, and combinations thereof (e.g., hydrogenated starch hydrolysates). In some embodiments, the sweetener is xylitol, sucralose, or a combination thereof.

When present, a sweetener or combination of sweeteners may make up from about 0.1 to about 20% or more of the of the composition by weight, for example, from about 0.1 to about 1%, from about 1 to about 5%, from about 5 to about 10%, or from about 10 to about 20% by weight, based on the total weight of the composition. In some embodiments, a combination of sweeteners is present at a concentration of from about 1% to about 3% by weight of the composition.

Flavoring Agents

In some embodiments, the composition comprises a flavoring agent. As used herein, a "flavoring agent" or "flavorant" is any flavorful or aromatic substance capable of altering the sensory characteristics associated with the oral product. Examples of sensory characteristics that can be modified by the flavoring agent include taste, mouthfeel, moistness, coolness/heat, and/or fragrance/aroma. Flavoring agents may be natural or synthetic, and the character of the flavors imparted thereby may be described, without limitation, as fresh, sweet, herbal, confectionary, floral, fruity, or spicy. Specific types of flavors include, but are not limited to, vanilla, coffee, chocolate/cocoa, cream, mint, spearmint, menthol, peppermint, wintergreen, eucalyptus, lavender, cardamom, nutmeg, cinnamon, clove, cascarilla, sandalwood, honey, jasmine, ginger, anise, sage, licorice, lemon, orange, apple, peach, lime, cherry, strawberry, trigeminal sensates, terpenes and any combinations thereof. See also, Leffingwell et al., Tobacco Flavoring for Smoking Products, R. J. Reynolds Tobacco Company (1972), which is incorporated herein by reference. Flavoring agents also may include components that are considered moistening, cooling or smoothening agents, such as eucalyptus. These flavors may be provided neat (i.e., alone) or in a composite, and may be employed as concentrates or flavor packages (e.g., spearmint and menthol, orange and cinnamon; lime, pineapple, and the like). Representative types of components also are set forth in U.S. Pat. No. 5,387,416 to White et al.; US Pat. App. Pub. No. 2005/0244521 to Strickland et al.; and PCT Application Pub. No. WO 05/041699 to Quinter et al., each of which is incorporated herein by reference. In some instances, the flavoring agent may be provided in a spray-dried form or a liquid form.

The amount of flavoring agent utilized in the composition can vary, but is typically up to about 10% by weight, and certain embodiments are characterized by a flavoring agent content of at least about 0.1% by weight, such as about 0.5 to about 10%, about 1 to about 5%, or about 2 to about 4% weight, based on the total weight of the composition.

Taste Modifiers

In order to improve the organoleptic properties of a composition as disclosed herein, the composition may include one or more taste modifying agents ("taste modifiers") which may serve to mask, alter, block, or improve e.g., the flavor of a composition as described herein. Non-limiting examples of such taste modifiers include analgesic or anesthetic herbs, spices, and flavors which produce a perceived cooling (e.g., menthol, eucalyptus, mint), warming (e.g., cinnamon), or painful (e.g., capsaicin) sensation. Certain taste modifiers fall into more than one overlapping category.

In some embodiments, the taste modifier modifies one or more of bitter, sweet, salty, or sour tastes. In some embodiments, the taste modifier targets pain receptors. In some embodiments, the composition comprises an active ingredient having a bitter taste, and a taste modifier which masks or blocks the perception of the bitter taste. In some embodiments, the taste modifier is a substance which targets pain receptors (e.g., vanilloid receptors) in the user's mouth to mask e.g., a bitter taste of another component (e.g., an active ingredient). In some embodiments, the taste modifier is capsaicin.

In some embodiments, the taste modifier is the amino acid gamma-amino butyric acid (GABA), referenced herein above with respect to amino acids. Studies in mice suggest that GABA may serve function(s) in taste buds in addition to synaptic inhibition. See, e.g., Dvoryanchikov et al., J Neurosci. 2011 Apr. 13; 31(15):5782-91. Without wishing to be bound by theory, GABA may suppress the perception of certain tastes, such as bitterness. In some embodiments, the composition comprises caffeine and GABA.

In some embodiments, the taste modifier is adenosine monophosphate (AMP). AMP is a naturally occurring nucleotide substance which can block bitter food flavors or enhance sweetness. It does not directly alter the bitter flavor, but may alter human perception of "bitter" by blocking the associated receptor.

In some embodiments, the taste modifier is lactisole. Lactisole is an antagonist of sweet taste receptors. Temporarily blocking sweetness receptors may accentuate e.g., savory notes.

When present, a representative amount of taste modifier is about 0.01% by weight or more, about 0.1% by weight or more, or about 1.0% by weight or more, but will typically make up less than about 10% by weight of the total weight of the composition, (e.g., from about 0.01%, about 0.05%, about 0.1%, or about 0.5%, to about 1%, about 5%, or about 10% by weight of the total weight of the composition).

In a still further aspect is provided a method for modifying the flavor profile of an active ingredient in a composition, the composition comprising a filler in an amount of at least 20%, based on the total weight of the composition; at least one active ingredient comprising one or more botanical materials, stimulants, amino acids, vitamins, antioxidants, nicotine components, cannabinoids, pharmaceutical agents, or a combination thereof; a salt; and at least one sweetener; wherein the product composition has a moisture content of at least about 40% by weight, based on the total weight of the composition; wherein the method comprises providing a taste modifier in the product composition in an amount effective to mask or modify a taste sensation in the mouth of the user of the composition. In some embodiments, the taste modifier selected from the group consisting of an analgesic or anesthetic herb, spice, or flavor which produces a perceived cooling or warming effect, gamma-aminobutyric acid, capsaicin, and adenosine monophosphate. In some embodiments, the taste sensation is bitterness, sweetness, saltiness, or sourness. In some embodiments, the taste sensation is bitterness. In some embodiments, the taste modifier is capsaicin.

Binders

A binder (or combination of binders) may be employed in certain embodiments, in amounts sufficient to provide the desired physical attributes and physical integrity to the composition. Typical binders can be organic or inorganic, or a combination thereof. Representative binders include cellulose derivatives, povidone, alginates (e.g., sodium alginate), starch-based binders, pectin, carrageenan, pullulan, zein, and the like, and combinations thereof. A binder may be employed in amounts sufficient to provide the desired physical attributes and physical integrity to the composition. The amount of binder utilized in the composition can vary based on the binder and the desired composition properties, but is typically up to about 30% by weight, and certain embodiments are characterized by a binder content of at least about 0.1% by weight, such as about 0.5 to about 30% by weight, or about 1 to about 10% by weight, based on the total weight of the composition.

In one embodiment, the binder comprises a cellulose derivative. In certain embodiments, the cellulose derivative is a cellulose ether (including carboxyalkyl ethers), meaning a cellulose polymer with the hydrogen of one or more hydroxyl groups in the cellulose structure replaced with an alkyl, hydroxyalkyl, or aryl group. Non-limiting examples of such cellulose derivatives include methylcellulose, hydroxypropylcellulose ("HPC"), hydroxypropylmethylcellulose ("HPMC"), hydroxyethyl cellulose, and carboxymethylcellulose ("CMC"). In one embodiment, the cellulose derivative is one or more of methylcellulose, HPC, HPMC, hydroxyethyl cellulose, and CMC. In some embodiments, the cellulose derivative is HPC. In one embodiment, the cellulose derivative is a combination of HPC and HPMC. In some embodiments, the composition comprises from about 1 to about 5% by weight of HPC, for example, from about 1%, about 2%, or about 3%, to about 4%, or about 5% by weight of the composition.

In certain embodiments, the composition includes a gum binder, for example, a natural gum. As used herein, a natural gum refers to polysaccharide materials of natural origin that have binding properties, and which are also useful as a thickening or gelling agents. Representative natural gums derived from plants, which are typically water soluble to some degree, include xanthan gum, guar gum, gum arabic, ghatti gum, gum tragacanth, karaya gum, locust bean gum, gellan gum, and combinations thereof. When present, natural gum binder materials are typically present in an amount of up to about 5% by weight, for example, from about 0.1, about 0.2, about 0.3, about 0.4, about 0.5, about 0.6, about 0.7, about 0.8, about 0.9, or about 1%, to about 2, about 3, about 4, or about 5% by weight, based on the total weight of the composition.

In certain embodiments, the composition includes an alginate binder (e.g., sodium or ammonium alginate). In certain embodiments, the binder comprises a combination of HPC and sodium alginate. When present as a binder, alginate materials are typically present in an amount of up to about 1% by weight, for example, from about 0.1, about 0.2, about 0.3, about 0.4, or about 0.5, to about 0.6, about 0.7, about 0.8, about 0.9, or about 1%, by weight, based on the total weight of the composition.

Organic Acid

In some embodiments, the composition comprises an organic acid. As used herein, the term "organic acid" refers to an organic (i.e., carbon-based) compound that is characterized by acidic properties. Typically, organic acids are relatively weak acids (i.e., they do not dissociate completely in the presence of water), such as carboxylic acids (—$CO_2H$) or sulfonic acids (—$SO_2OH$). As used herein, reference to organic acid means an organic acid that is intentionally added. In this regard, an organic acid may be intentionally added as a specific mixture ingredient as opposed to merely being inherently present as a component of another mixture ingredient (e.g., the small amount of organic acid which may inherently be present in a mixture ingredient such as a tobacco material). In some embodiments, the one or more organic acids are added neat (i.e., in their free acid, native solid or liquid form) or as a solution in, e.g., water. In some embodiments, the one or more organic acids are added in the form of a salt, as described herein below.

Suitable organic acids will typically have a range of lipophilicities (i.e., a polarity giving an appropriate balance of water and organic solubility). Lipophilicity is conveniently measured in terms of logP, the partition coefficient of a molecule between an aqueous and lipophilic phase, usually water and octanol, respectively. Typically, lipophilicities of organic acids may be between about −2 and about 6.5. In some embodiments, the organic acid may be more soluble in water than in octanol (i.e., having a negative logP value, such as from about −2 to about −1). In some embodiments, the organic acid may be about equally soluble in octanol than in water (i.e., having a logP value of about 0). In some embodiments, the organic acid may be more soluble in octanol than in water (i.e., having a positive logP value, such as from about 1 to about 6.5). In some embodiments, the organic acid has a logP value of from about 1.5 to about 5.0, e.g., from about 1.5, about 2.0, about 2.5, or about 3.0, to about 3.5, about 4.0, about 4.5, or about 5.0.

In some embodiments, the organic acid is a carboxylic acid or a sulfonic acid. The carboxylic acid or sulfonic acid functional group may be attached to any alkyl, cycloalkyl, heterocycloalkyl, aryl, or heteroaryl group having, for example, from one to twenty carbon atoms ($C_1$-$C_{20}$). In some embodiments, the organic acid is an alkyl, cycloalkyl, heterocycloalkyl, aryl, or heteroaryl carboxylic or sulfonic acid.

As used herein, "alkyl" refers to any straight chain or branched chain hydrocarbon. The alkyl group may be saturated (i.e., having all $sp^3$ carbon atoms), or may be unsaturated (i.e., having at least one site of unsaturation). As used herein, the term "unsaturated" refers to the presence of a carbon-carbon, $sp^2$ double bond in one or more positions within the alkyl group. Unsaturated alkyl groups may be mono- or polyunsaturated. Representative straight chain alkyl groups include, but are not limited to, methyl, ethyl, n-propyl, n-butyl, n-pentyl, and n-hexyl. Branched chain alkyl groups include, but are not limited to, isopropyl, sec-butyl, isobutyl, tert-butyl, isopentyl, and 2-methylbutyl. Representative unsaturated alkyl groups include, but are not limited to, ethylene or vinyl, allyl, 1-butenyl, 2-butenyl, isobutylenyl, 1-pentenyl, 2-pentenyl, 3-methyl-1-butenyl, 2-methyl-2-butenyl, 2,3-dimethyl-2-butenyl, and the like. An alkyl group can be unsubstituted or substituted.

"Cycloalkyl" as used herein refers to a carbocyclic group, which may be mono- or bicyclic. Cycloalkyl groups include rings having 3 to 7 carbon atoms as a monocycle or 7 to 12 carbon atoms as a bicycle. Examples of monocyclic cycloalkyl groups include cyclopropyl, cyclobutyl, cyclopentyl, cyclohexyl, cycloheptyl, and cyclooctyl. A cycloalkyl group can be unsubstituted or substituted, and may include one or more sites of unsaturation (e.g., cyclopentenyl or cyclohexenyl).

The term "aryl" as used herein refers to a carbocyclic aromatic group. Examples of aryl groups include, but are not limited to, phenyl and naphthyl. An aryl group can be unsubstituted or substituted.

"Heteroaryl" and "heterocycloalkyl" as used herein refer to an aromatic or non-aromatic ring system, respectively, in which one or more ring atoms is a heteroatom, e.g. nitrogen, oxygen, and sulfur. The heteroaryl or heterocycloalkyl group comprises up to 20 carbon atoms and from 1 to 3 heteroatoms selected from N, O, and S. A heteroaryl or heterocycloalkyl may be a monocycle having 3 to 7 ring members (for example, 2 to 6 carbon atoms and 1 to 3 heteroatoms selected from N, O, and S) or a bicycle having 7 to 10 ring members (for example, 4 to 9 carbon atoms and 1 to 3 heteroatoms selected from N, O, and S), for example: a bicyclo[4,5], [5,5], [5,6], or [6,6] system. Examples of heteroaryl groups include by way of example and not limitation, pyridyl, thiazolyl, tetrahydrothiophenyl, pyrimidinyl, furanyl, thienyl, pyrrolyl, pyrazolyl, imidazolyl, tetrazolyl, benzofuranyl, thianaphthalenyl, indolyl, indolenyl, quinolinyl, isoquinolinyl, benzimidazolyl, isoxazolyl, pyrazinyl, pyridazinyl, indolizinyl, isoindolyl, 3H-indolyl, 1H-indazolyl, purinyl, 4H-quinolizinyl, phthalazinyl, naphthyridinyl, quinoxalinyl, quinazolinyl, cinnolinyl, pteridinyl, 4aH-carbazolyl, carbazolyl, phenanthridinyl, acridinyl, pyrimidinyl, phenanthrolinyl, phenazinyl, phenothiazinyl, furazanyl, phenoxazinyl, isochromanyl, chromanyl, imidazolidinyl, imidazolinyl, pyrazolidinyl, pyrazolinyl, benzotriazolyl, benzisoxazolyl, and isatinoyl. Examples of heterocycloalkyls include by way of example and not limitation, dihydroypyridyl, tetrahydropyridyl (piperidyl), tetrahydrothiophenyl, piperidinyl, 4-piperidonyl, pyrrolidinyl, 2-pyrrolidonyl, tetrahydrofuranyl, tetrahydropyranyl, bis-tetrahydropyranyl, tetrahydroquinolinyl, tetrahydroisoquinolinyl, decahydroquinolinyl, octahydroisoquinolinyl, piperazinyl, quinuclidinyl, and morpholinyl. Heteroaryl and heterocycloalkyl groups can be unsubstituted or substituted.

"Substituted" as used herein and as applied to any of the above alkyl, aryl, cycloalkyl, heteroaryl, heterocyclyl, means that one or more hydrogen atoms are each independently replaced with a substituent. Typical substituents include, but are not limited to, —Cl, Br, F, alkyl, —OH, —$OCH_3$, $NH_2$, —$NHCH_3$, —$N(CH_3)_2$, —CN, —NC(=O)$CH_3$, —C(=O)—, —C(=O)$NH_2$, and —C(=O)$N(CH_3)_2$. Wherever a group is described as "optionally substituted," that group can be substituted with one or more of the above substituents, independently selected for each occasion. In some embodiments, the substituent may be one or more methyl groups or one or more hydroxyl groups.

In some embodiments, the organic acid is an alkyl carboxylic acid. Non-limiting examples of alkyl carboxylic acids include formic acid, acetic acid, propionic acid, octanoic acid, nonanoic acid, decanoic acid, undecanoic acid, dodecanoic acid, stearic acid, oleic acid, linoleic acid, linolenic acid, and the like. In some embodiments, the organic acid is an alkyl sulfonic acid. Non-limiting examples of alkyl sulfonic acids include propanesulfonic acid and octanesulfonic acid.

In some embodiments, the alkyl carboxylic or sulfonic acid is substituted with one or more hydroxyl groups. Non-limiting examples include glycolic acid, 4-hydroxybutyric acid, and lactic acid.

In some embodiments, an organic acid may include more than one carboxylic acid group or more than one sulfonic acid group (e.g., two, three, or more carboxylic acid groups). Non-limiting examples include oxalic acid, fumaric acid, maleic acid, and glutaric acid. In organic acids containing multiple carboxylic acids (e.g., from two to four carboxylic acid groups), one or more of the carboxylic acid groups may be esterified. Non-limiting examples include succinic acid monoethyl ester, monomethyl fumarate, monomethyl or dimethyl citrate, and the like.

In some embodiments, the organic acid may include more than one carboxylic acid group and one or more hydroxyl groups. Non-limiting examples of such acids include tartaric acid, citric acid, and the like.

In some embodiments, the organic acid is an aryl carboxylic acid or an aryl sulfonic acid. Non-limiting examples of aryl carboxylic and sulfonic acids include benzoic acid, toluic acids, salicylic acid, benzenesulfonic acid, and p-toluenesulfonic acid.

Additional non-limiting examples of suitable organic acids include 2,2-dichloroacetic acid, 2-hydroxyethanesulfonic acid, 2-oxoglutaric acid, 4-acetamidobenzoic acid, 4-aminosalicylic acid, acetic acid, adipic acid, ascorbic acid (L), aspartic acid (L), camphoric acid (+), camphor-10-sulfonic acid (+), capric acid, caproic acid, caprylic acid, cinnamic acid, cyclamic acid, decanoic acid, dodecylsulfuric acid, ethane-1,2-disulfonic acid, ethanesulfonic acid, formic acid, fumaric acid, galactaric acid, gentisic acid, glucoheptonic acid, gluconic acid, glucuronic acid, glutamic acid, glycerophosphoric acid, glycolic acid, hippuric acid, isobutyric acid, lactobionic acid, lauric acid, malonic acid, mandelic acid, methanesulfonic acid, naphthalene-1,5-disulfonic acid, naphthalene-2-sulfonic acid, oleic acid, palmitic acid, pamoic acid, pyroglutamic acid, sebacic acid, stearic acid, and undecylenic acid.

In some embodiments, the one or more organic acids is a single organic acid. In some embodiments, the one or more organic acids is a combination of several acids, such as two, three, or more organic acids.

In some embodiments, the organic acid is citric acid, malic acid, tartaric acid, octanoic acid, benzoic acid, a toluic acid, salicylic acid, or a combination thereof. In some embodiments, the organic acid is benzoic acid. In some embodiments, the organic acid is citric acid.

In alternative embodiments, a portion, or even all, of the organic acid may be added in the form of a salt with an alkaline component, which may include, but is not limited to, nicotine. Non-limiting examples of suitable salts, e.g., for nicotine, include formate, acetate, propionate, isobutyrate, butyrate, alpha-methylbutyate, isovalerate, beta-methylvalerate, caproate, 2-furoate, phenylacetate, heptanoate, octanoate, nonanoate, oxalate, malonate, glycolate, benzoate, tartrate, levulinate, ascorbate, fumarate, citrate, malate, lactate, aspartate, salicylate, tosylate, succinate, pyruvate, and the like. In some embodiments, the organic acid or a portion thereof may be added in the form of a salt with an alkali metal such as sodium, potassium, and the like. In organic acids having more than one acidic group (such as a di- or tri-carboxylic acid), in some instances, one or more of these acid groups may be in the form of such a salt. Suitable non-limiting examples include monosodium citrate, disodium citrate, and the like. In some embodiments, the organic acid is a salt of citric acid, malic acid, tartaric acid, octanoic acid, benzoic acid, a toluic acid, salicylic acid, or a combination thereof. In some embodiments, the organic acid is a mono or di-ester of a di- or tri-carboxylic acid, respectively, such as a monomethyl ester of citric acid, malic acid, or tartaric acid, or a dimethyl ester of citric acid.

The amount of organic acid present in the mixture may vary. Generally, the mixture comprises from about 0.1 to about 10% by weight of organic acid, present as one or more organic acids, based on the total weight of the mixture. In some embodiments, the mixture comprises about 0.1%, about 0.2%, about 0.3%, about 0.4%, about 0.5%, about 0.6%, about 0.7%, about 0.8%, about 0.9%, about 1%, about 2%, about 3%, about 4%, about 5%, about 6%, about 7%, about 8%, about 9%, or about 10% organic acid by weight, based on the total weight of the mixture. In some embodiments, the mixture comprises from about 0.1 to about 0.5% by weight of organic acid, for example, about 0.1, about 0.15, about 0.2, about 0.25, about 0.3, about 0.35, about 0.4, about 0.45, or about 0.5% by weight, based on the total weight of the mixture. In some embodiments, the mixture comprises from about 0.25 to about 0.35% by weight of organic acid, for example, from about 0.25, about 0.26, about 0.27, about 0.28, about 0.29, or about 0.3, to about 0.31, about 0.32, about 0.33, about 0.34, or about 0.35% by weight, based on the total weight of the mixture. In the case where a salt of an organic acid is added, the percent by weight is calculated based on the weight of the free acid, not including any counter-ion which may be present.

Buffering Agents

In certain embodiments, the composition of the present disclosure can comprise pH adjusters or buffering agents. Examples of pH adjusters and buffering agents that can be used include, but are not limited to, metal hydroxides (e.g., alkali metal hydroxides such as sodium hydroxide and potassium hydroxide), and other alkali metal buffers such as metal carbonates (e.g., potassium carbonate or sodium carbonate), or metal bicarbonates such as sodium bicarbonate, and the like. Non-limiting examples of suitable buffers include alkali metals acetates, glycinates, phosphates, glycerophosphates, citrates, carbonates, hydrogen carbonates, borates, or mixtures thereof. In some embodiments, the buffer is sodium bicarbonate.

Where present, the buffering agent is typically present in an amount less than about 5% by weight, based on the weight of the composition, for example, from about 0.1% to about 5%, such as, e.g., from about 0.1% to about 1%, or from about 0.1% to about 0.5% by weight, based on the total weight of the composition.

Colorants

A colorant may be employed in amounts sufficient to provide the desired physical attributes to the composition. Examples of colorants include various dyes and pigments, such as caramel coloring and titanium dioxide. The amount of colorant utilized in the composition can vary, but when present is typically up to about 3% by weight, such as from about 0.1%, about 0.5%, or about 1%, to about 3% by weight, based on the total weight of the composition.

Humectants

In certain embodiments, one or more humectants may be employed in the composition. Examples of humectants include, but are not limited to, glycerin, propylene glycol, and the like. Where included, the humectant is typically provided in an amount sufficient to provide desired moisture attributes to the composition. Further, in some instances, the humectant may impart desirable flow characteristics to the composition for depositing in a mold. In some embodiments, the humectant is propylene glycol.

When present, a humectant will typically make up about 5% or less of the weight of the composition (e.g., from about 0.1 to about 5% by weight), for example, from about 0.1% to about 1% by weight, or about 1% to about 5% by weight, based on the total weight of the composition.

Oral Care Additives

In some embodiments, the composition comprises an oral care ingredient (or mixture of such ingredients). Oral care ingredients provide the ability to inhibit tooth decay or loss, inhibit gum disease, relieve mouth pain, whiten teeth, or otherwise inhibit tooth staining, elicit salivary stimulation, inhibit breath malodor, freshen breath, or the like. For example, effective amounts of ingredients such as thyme oil, eucalyptus oil and zinc (e.g., such as the ingredients of formulations commercially available as ZYTEX® from Discus Dental) can be incorporated into the composition. Other examples of ingredients that can be incorporated in desired effective amounts within the present composition can include those that are incorporated within the types of oral care compositions set forth in Takahashi et al., Oral Microbiology and Immunology, 19(1), 61-64 (2004); U.S. Pat. No. 6,083,527 to Thistle; and US Pat. Appl. Pub. Nos. 2006/0210488 to Jakubowski and 2006/02228308 to Cummins et al. Other exemplary ingredients of tobacco containing-formulation include those contained in formulations marketed as MALTISORB® by Roquette and DENTIZYME® by NatraRx. When present, a representative amount of oral care additive is at least about 1%, often at least about 3%, and frequently at least about 5% of the total dry weight of the composition. The amount of oral care additive within the composition will not typically exceed about 30%, often will not exceed about 25%, and frequently will not exceed about 20%, of the total dry weight of the composition.

Other Additives

Other additives can be included in the disclosed composition. For example, the composition can be processed, blended, formulated, combined, and/or mixed with other materials or ingredients. The additives can be artificial, or can be obtained or derived from herbal or biological sources. Examples of further types of additives include thickening or gelling agents (e.g., fish gelatin), emulsifiers, preservatives (e.g., potassium sorbate and the like), disintegration aids, or combinations thereof. See, for example, those representative components, combination of components, relative amounts of those components, and manners and methods for employing those components, set forth in U.S. Pat. No. 9,237,769 to Mua et al., U.S. Pat. No. 7,861,728 to Holton, Jr. et al., US Pat. App. Pub. No. 2010/0291245 to Gao et al., and US Pat. App. Pub. No. 2007/0062549 to Holton, Jr. et al., each of which is incorporated herein by reference. Typical inclusion ranges for such additional additives can vary depending on the nature and function of the additive and the intended effect on the final composition, with an example range of up to about 10% by weight, based on total weight of the composition (e.g., about 0.1 to about 5% by weight).

The aforementioned additives can be employed together (e.g., as additive formulations) or separately (e.g., individual additive components can be added at different stages involved in the preparation of the final composition). Furthermore, the aforementioned types of additives may be encapsulated as provided in the final product or composition. Exemplary encapsulated additives are described, for example, in WO2010/132444 to Atchley, which has been previously incorporated by reference herein.

Tobacco Material

In some embodiments, the composition may include a tobacco material. The tobacco material can vary in species, type, and form. Generally, the tobacco material is obtained from for a harvested plant of the *Nicotiana* species. Example *Nicotiana* species include *N. tabacum, N. rustica, N. alata, N. arentsii, N. excelsior, N. forgetiana, N. glauca, N. glutinosa, N. gossei, N. kawakamii, N. knightiana, N. langsdorffi, N. otophora, N. setchelli, N. sylvestris, N. tomentosa, N. tomentosiformis, N. undulata, N.* x *sanderae, N. africana, N. amplexicaulis, N. benavidesii, N. bonariensis, N. debneyi, N. longiflora, N. maritina, N. megalosiphon, N. occidentalis, N. paniculata, N. plumbaginifolia, N. raimondii, N. rosulata, N. simulans, N. stocktonii, N. suaveolens, N. umbratica, N. velutina, N. wigandioides, N. acaulis, N. acuminata, N. attenuata, N. benthamiana, N. cavicola, N. clevelandii, N. cordifolia, N. corymbosa, N. fragrans, N. goodspeedii, N. linearis, N. miersii, N. nudicaulis, N. obtusifolia, N. occidentalis* subsp. *Hersperis, N. pauciflora, N. petunioides, N. quadrivalvis, N. repanda, N. rotundifolia, N. solanifolia*, and *N. spegazzinii*. Various representative other types of plants from the *Nicotiana* species are set forth in Goodspeed, *The Genus Nicotiana*, (Chonica Botanica) (1954); U.S. Pat. No. 4,660,577 to Sensabaugh, Jr. et al.; U.S. Pat. No. 5,387,416 to White et al., U.S. Pat. No. 7,025,066 to Lawson et al.; U.S. Pat. No. 7,798,153 to Lawrence, Jr. and U.S. Pat. No. 8,186,360 to Marshall et al.; each of which is incorporated herein by reference. Descriptions of various types of tobaccos, growing practices and harvesting practices are set forth in *Tobacco Production, Chemistry and Technology*, Davis et al. (Eds.) (1999), which is incorporated herein by reference.

*Nicotiana* species from which suitable tobacco materials can be obtained can be derived using genetic-modification or crossbreeding techniques (e.g., tobacco plants can be genetically engineered or crossbred to increase or decrease production of components, characteristics or attributes). See, for example, the types of genetic modifications of plants set forth in U.S. Pat. No. 5,539,093 to Fitzmaurice et al.; U.S. Pat. No. 5,668,295 to Wahab et al.; U.S. Pat. No. 5,705,624 to Fitzmaurice et al.; U.S. Pat. No. 5,844,119 to Weigl; U.S. Pat. No. 6,730,832 to Dominguez et al.; U.S. Pat. No. 7,173,170 to Liu et al.; U.S. Pat. No. 7,208,659 to Colliver et al. and U.S. Pat. No. 7,230,160 to Benning et al.; US Patent Appl. Pub. No. 2006/0236434 to Conkling et al.; and PCT WO2008/103935 to Nielsen et al. See, also, the types of tobaccos that are set forth in U.S. Pat. No. 4,660,577 to Sensabaugh, Jr. et al.; U.S. Pat. No. 5,387,416 to White et al.; and U.S. Pat. No. 6,730,832 to Dominguez et al., each of which is incorporated herein by reference.

The *Nicotiana* species can, in some embodiments, be selected for the content of various compounds that are present therein. For example, plants can be selected on the basis that those plants produce relatively high quantities of one or more of the compounds desired to be isolated therefrom. In certain embodiments, plants of the *Nicotiana* species (e.g., *Galpao commun* tobacco) are specifically grown for their abundance of leaf surface compounds. Tobacco plants can be grown in greenhouses, growth chambers, or outdoors in fields, or grown hydroponically.

Various parts or portions of the plant of the *Nicotiana* species can be included within a composition as disclosed herein. For example, virtually all of the plant (e.g., the whole plant) can be harvested, and employed as such. Alternatively, various parts or pieces of the plant can be harvested or separated for further use after harvest. For example, the flower, leaves, stem, stalk, roots, seeds, and various combinations thereof, can be isolated for further use or treatment. In some embodiments, the tobacco material comprises tobacco leaf (lamina). The composition disclosed herein can include processed tobacco parts or pieces, cured and aged tobacco in essentially natural lamina and/or stem form, a tobacco extract, extracted tobacco pulp (e.g., using water as a solvent), or a mixture of the foregoing (e.g., a mixture that combines extracted tobacco pulp with granulated cured and aged natural tobacco lamina).

In certain embodiments, the tobacco material comprises solid tobacco material selected from the group consisting of lamina and stems. The tobacco that is used for the mixture most preferably includes tobacco lamina, or a tobacco lamina and stem mixture (of which at least a portion is smoke-treated). Portions of the tobaccos within the mixture may have processed forms, such as processed tobacco stems (e.g., cut-rolled stems, cut-rolled-expanded stems or cut-puffed stems), or volume expanded tobacco (e.g., puffed tobacco, such as dry ice expanded tobacco (DIET)). See, for example, the tobacco expansion processes set forth in U.S. Pat. No. 4,340,073 to de la Burde et al.; U.S. Pat. No. 5,259,403 to Guy et al.; and U.S. Pat. No. 5,908,032 to Poindexter, et al.; and U.S. Pat. No. 7,556,047 to Poindexter, et al., all of which are incorporated by reference. In addition, the d mixture optionally may incorporate tobacco that has been fermented. See, also, the types of tobacco processing techniques set forth in PCT WO2005/063060 to Atchley et al., which is incorporated herein by reference.

The tobacco material is typically used in a form that can be described as particulate (i.e., shredded, ground, granulated, or powder form). The manner by which the tobacco material is provided in a finely divided or powder type of form may vary. Preferably, plant parts or pieces are comminuted, ground or pulverized into a particulate form using equipment and techniques for grinding, milling, or the like. Most preferably, the plant material is relatively dry in form during grinding or milling, using equipment such as hammer mills, cutter heads, air control mills, or the like. For example, tobacco parts or pieces may be ground or milled when the moisture content thereof is less than about 15% by weight, or less than about % by weight. Most preferably, the tobacco material is employed in the form of parts or pieces that have an average particle size between 1.4 millimeters and 250 microns. In some instances, the tobacco particles may be sized to pass through a screen mesh to obtain the particle size range required. If desired, air classification equipment may be used to ensure that small sized tobacco particles of the desired sizes, or range of sizes, may be collected. If desired, differently sized pieces of granulated tobacco may be mixed together.

The manner by which the tobacco is provided in a finely divided or powder type of form may vary. Preferably, tobacco parts or pieces are comminuted, ground or pulverized into a powder type of form using equipment and techniques for grinding, milling, or the like. Most preferably, the tobacco is relatively dry in form during grinding or milling, using equipment such as hammer mills, cutter heads, air control mills, or the like. For example, tobacco parts or pieces may be ground or milled when the moisture content thereof is less than about 15% by weight to less than about 5% by weight. For example, the tobacco plant or portion thereof can be separated into individual parts or pieces (e.g., the leaves can be removed from the stems, and/or the stems and leaves can be removed from the stalk). The harvested plant or individual parts or pieces can be further subdivided into parts or pieces (e.g., the leaves can be shredded, cut, comminuted, pulverized, milled or ground into pieces or parts that can be characterized as filler-type pieces, granules, particulates or fine powders). The plant, or parts thereof, can be subjected to external forces or pressure (e.g., by being pressed or subjected to roll treatment). When carrying out such processing conditions, the plant or portion thereof can have a moisture content that approximates its natural moisture content (e.g., its moisture content immediately upon harvest), a moisture content achieved by adding moisture to the plant or portion thereof, or a moisture content that results from the drying of the plant or portion thereof. For example, powdered, pulverized, ground or milled pieces of plants or portions thereof can have moisture contents of less than about 25% by weight, often less than about 20%, and frequently less than about 15% by weight.

For the preparation of oral products, it is typical for a harvested plant of the *Nicotiana* species to be subjected to a curing process. The tobacco materials incorporated within the mixture for inclusion within products as disclosed herein are those that have been appropriately cured and/or aged. Descriptions of various types of curing processes for various types of tobaccos are set forth in *Tobacco Production, Chemistry and Technology*, Davis et al. (Eds.) (1999). Examples of techniques and conditions for curing flue-cured tobacco are set forth in Nestor et al., *Beitrage Tabakforsch. Int.,* 20, 467-475 (2003) and U.S. Pat. No. 6,895,974 to Peele, which are incorporated herein by reference. Representative techniques and conditions for air curing tobacco are set forth in U.S. Pat. No. 7,650,892 to Groves et al.; Roton et al., *Beitrage Tabakforsch. Int.,* 21, 305-320 (2005) and Staaf et al., *Beitrage Tabakforsch. Int.,* 21, 321-330

(2005), which are incorporated herein by reference. Certain types of tobaccos can be subjected to alternative types of curing processes, such as fire curing or sun curing.

In certain embodiments, tobacco materials that can be employed include flue-cured or Virginia (e.g., K326), burley, sun-cured (e.g., Indian Kurnool and Oriental tobaccos, including Katerini, Prelip, Komotini, Xanthi and Yambol tobaccos), Maryland, dark, dark-fired, dark air cured (e.g., Madole, Passanda, Cubano, Jatin and Bezuki tobaccos), light air cured (e.g., North Wisconsin and Galpao tobaccos), Indian air cured, Red Russian and *Rustica* tobaccos, as well as various other rare or specialty tobaccos and various blends of any of the foregoing tobaccos.

The tobacco material may also have a so-called "blended" form. For example, the tobacco material may include a mixture of parts or pieces of flue-cured, burley (e.g., Malawi burley tobacco) and Oriental tobaccos (e.g., as tobacco composed of, or derived from, tobacco lamina, or a mixture of tobacco lamina and tobacco stem). For example, a representative blend may incorporate about 30 to about 70 parts burley tobacco (e.g., lamina, or lamina and stem), and about 30 to about 70 parts flue cured tobacco (e.g., stem, lamina, or lamina and stem) on a dry weight basis. Other example tobacco blends incorporate about 75 parts flue-cured tobacco, about 15 parts burley tobacco, and about 10 parts Oriental tobacco; or about 65 parts flue-cured tobacco, about 25 parts burley tobacco, and about 10 parts Oriental tobacco; or about 65 parts flue-cured tobacco, about 10 parts burley tobacco, and about 25 parts Oriental tobacco; on a dry weight basis. Other example tobacco blends incorporate about 20 to about 30 parts Oriental tobacco and about 70 to about 80 parts flue-cured tobacco on a dry weight basis.

Tobacco materials used in the present disclosure can be subjected to, for example, fermentation, bleaching, and the like. If desired, the tobacco materials can be, for example, irradiated, pasteurized, or otherwise subjected to controlled heat treatment. Such treatment processes are detailed, for example, in U.S. Pat. No. 8,061,362 to Mua et al., which is incorporated herein by reference. In certain embodiments, tobacco materials can be treated with water and an additive capable of inhibiting reaction of asparagine to form acrylamide upon heating of the tobacco material (e.g., an additive selected from the group consisting of lysine, glycine, histidine, alanine, methionine, cysteine, glutamic acid, aspartic acid, proline, phenylalanine, valine, arginine, compositions incorporating di- and trivalent cations, asparaginase, certain non-reducing saccharides, certain reducing agents, phenolic compounds, certain compounds having at least one free thiol group or functionality, oxidizing agents, oxidation catalysts, natural plant extracts (e.g., rosemary extract), and combinations thereof. See, for example, the types of treatment processes described in U.S. Pat. Nos. 8,434,496, 8,944,072, and 8,991,403 to Chen et al., which are all incorporated herein by reference. In certain embodiments, this type of treatment is useful where the original tobacco material is subjected to heat in the processes previously described.

In various embodiments, the tobacco material can be treated to extract a soluble component of the tobacco material therefrom. "Tobacco extract" as used herein refers to the isolated components of a tobacco material that are extracted from solid tobacco pulp by a solvent that is brought into contact with the tobacco material in an extraction process. Various extraction techniques of tobacco materials can be used to provide a tobacco extract and tobacco solid material. See, for example, the extraction processes described in US Pat. Appl. Pub. No. 2011/0247640 to Beeson et al., which is incorporated herein by reference. Other example techniques for extracting components of tobacco are described in U.S. Pat. No. 4,144,895 to Fiore; U.S. Pat. No. 4,150,677 to Osborne, Jr. et al.; U.S. Pat. No. 4,267,847 to Reid; U.S. Pat. No. 4,289,147 to Wildman et al.; U.S. Pat. No. 4,351,346 to Brummer et al.; U.S. Pat. No. 4,359,059 to Brummer et al.; U.S. Pat. No. 4,506,682 to Muller; U.S. Pat. No. 4,589,428 to Keritsis; U.S. Pat. No. 4,605,016 to Soga et al.; U.S. Pat. No. 4,716,911 to Poulose et al.; U.S. Pat. No. 4,727,889 to Niven, Jr. et al.; U.S. Pat. No. 4,887,618 to Bernasek et al.; U.S. Pat. No. 4,941,484 to Clapp et al.; U.S. Pat. No. 4,967,771 to Fagg et al.; U.S. Pat. No. 4,986,286 to Roberts et al.; U.S. Pat. No. 5,005,593 to Fagg et al.; U.S. Pat. No. 5,018,540 to Grubbs et al.; U.S. Pat. No. 5,060,669 to White et al.; U.S. Pat. No. 5,065,775 to Fagg; U.S. Pat. No. 5,074,319 to White et al.; U.S. Pat. No. 5,099,862 to White et al.; U.S. Pat. No. 5,121,757 to White et al.; U.S. Pat. No. 5,131,414 to Fagg; U.S. Pat. No. 5,131,415 to Munoz et al.; U.S. Pat. No. 5,148,819 to Fagg; U.S. Pat. No. 5,197,494 to Kramer; U.S. Pat. No. 5,230,354 to Smith et al.; U.S. Pat. No. 5,234,008 to Fagg; U.S. Pat. No. 5,243,999 to Smith; U.S. Pat. No. 5,301,694 to Raymond et al.; U.S. Pat. No. 5,318,050 to Gonzalez-Parra et al.; U.S. Pat. No. 5,343,879 to Teague; U.S. Pat. No. 5,360,022 to Newton; U.S. Pat. No. 5,435,325 to Clapp et al.; U.S. Pat. No. 5,445,169 to Brinkley et al.; U.S. Pat. No. 6,131,584 to Lauterbach; U.S. Pat. No. 6,298,859 to Kierulff et al.; U.S. Pat. No. 6,772,767 to Mua et al.; and U.S. Pat. No. 7,337,782 to Thompson, all of which are incorporated by reference herein.

In some embodiments, the type of tobacco material is selected such that it is initially visually lighter in color than other tobacco materials to some degree (e.g., whitened or bleached). Tobacco pulp can be whitened in certain embodiments according to any means known in the art, and as described above in reference to color-eliminated active ingredients.

Typical inclusion ranges for tobacco materials can vary depending on the nature and type of the tobacco material, and the intended effect on the final composition, with an example range of up to about 30% by weight (or up to about 20% by weight or up to about 10% by weight or up to about 5% by weight), based on total weight of the composition (e.g., about 0.1 to about 15% by weight). In some embodiments, the products of the disclosure can be characterized as completely free or substantially free of tobacco material (other than purified nicotine as an active ingredient). For example, certain embodiments can be characterized as having less than 1% by weight, or less than 0.5% by weight, or less than 0.1% by weight of tobacco material, or 0% by weight of tobacco material.

Preparation of the Composition

The manner by which the various components of the composition (e.g., filler, water, active ingredient, and the like) are combined may vary. As such, the overall composition with e.g., powdered composition components may be relatively uniform in nature. The components noted above, which may be in liquid or dry solid form, can be admixed in a pretreatment step prior to mixture with any remaining components of the composition, or simply mixed together with all other liquid or dry ingredients. The various components of the composition may be contacted, combined, or mixed together using any mixing technique or equipment known in the art. Any mixing method that brings the composition ingredients into intimate contact can be used, such as a mixing apparatus featuring an impeller or other structure capable of agitation. Examples of mixing equipment include casing drums, conditioning cylinders or drums, liquid spray apparatus, conical-type blenders, ribbon blenders, mixers available as FKM130, FKM600, FKM1200, FKM2000 and FKM3000 from Littleford Day, Inc., Plough Share types of mixer cylinders, Hobart mixers, and the like. See also, for example, the types of methodologies set forth in U.S. Pat. No. 4,148,325 to Solomon et al.; U.S. Pat. No. 6,510,855 to Korte et al.; and U.S. Pat. No. 6,834,654 to Williams, each of which is incorporated herein by reference. In some embodiments, the components forming the composition are prepared such that the mixture thereof may be used in a starch molding process for forming the composition. Manners and methods for formulating compositions will be apparent to those skilled in the art. See, for example, the types of methodologies set forth in U.S. Pat. No. 4,148,325 to Solomon et al.; U.S. Pat. No. 6,510,855 to Korte et al.; and U.S. Pat. No. 6,834,654 to Williams, U.S. Pat. No. 4,725,440 to Ridgway et al., and U.S. Pat. No. 6,077,524 to Bolder et al., each of which is incorporated herein by reference.

In some embodiments, the overall oral product or any component thereof can be described as a particulate material. As used herein, the term "particulate" refers to a material in the form of a plurality of individual particles, some of which can be in the form of an agglomerate of multiple particles, wherein the particles have an average length to width ratio less than 2:1, such as less than 1.5:1, such as about 1:1. In various embodiments, the particles of a particulate material can be described as substantially spherical or granular. In certain embodiments, either of the first non-tobacco cellulosic material and the second non-tobacco cellulosic material can be characterized as a particulate material. In certain embodiments, only the first non-tobacco cellulosic material can be characterized as a particulate material (e.g., MCC).

In some embodiments, the overall oral product or any component thereof can be described as a fibrous material. As used herein, the term "fibrous" or "fiber" refers to a material in the form of a plurality of fibers, some of which can be in the form of an agglomerate of multiple fibers, wherein the fibers have an average length to width ratio greater than 2.5:1, such as greater than 3:1, such as about 3:1 to about 6:1.

The particle size of a particulate or fibrous material may be measured by sieve analysis. As the skilled person will readily appreciate, sieve analysis (otherwise known as a gradation test) is a method used to measure the particle size distribution of a particulate material. Typically, sieve analysis involves a nested column of sieves which comprise screens, preferably in the form of wire mesh cloths. A pre-weighed sample may be introduced into the top or uppermost sieve in the column, which has the largest screen openings or mesh size (i.e. the largest pore diameter of the sieve). Each lower sieve in the column has progressively smaller screen openings or mesh sizes than the sieve above. Typically, at the base of the column of sieves is a receiver portion to collect any particles having a particle size smaller than the screen opening size or mesh size of the bottom or lowermost sieve in the column (which has the smallest screen opening or mesh size).

In some embodiments, the column of sieves may be placed on or in a mechanical agitator. The agitator causes the vibration of each of the sieves in the column. The mechanical agitator may be activated for a pre-determined period of time in order to ensure that all particles are collected in the correct sieve. In some embodiments, the column of sieves is agitated for a period of time from 0.5 minutes to 10 minutes, such as from 1 minute to 10 minutes, such as from 1 minute to 5 minutes, such as for approximately 3 minutes. Once the agitation of the sieves in the column is complete, the material collected on each sieve is weighed. The weight of each sample on each sieve may then be divided by the total weight in order to obtain a percentage of the mass retained on each sieve. As the skilled person will readily appreciate, the screen opening sizes or mesh sizes for each sieve in the column used for sieve analysis may be selected based on the granularity or known maximum/minimum particle sizes of the sample to be analysed. In some embodiments, a column of sieves may be used for sieve analysis, wherein the column comprises from 2 to 20 sieves, such as from 5 to 15 sieves. In some embodiments, a column of sieves may be used for sieve analysis, wherein the column comprises 10 sieves. In some embodiments, the largest screen opening or mesh sizes of the sieves used for sieve analysis may be 1000 μm, such as 500 μm, such as 400 μm, such as 300 μm.

In some embodiments, any material referenced herein (e.g., filler, tobacco material, and the overall oral product) characterized as being in particulate or fibrous form may have at least 50% by weight of particles with a particle size as measured by sieve analysis of no greater than about 1000 μm, such as no greater than about 500 μm, such as no greater than about 400 μm, such as no greater than about 350 μm, such as no greater than about 300 μm. In some embodiments, at least 60% by weight of the particles of any particulate or fibrous material referenced herein have a particle size as measured by sieve analysis of no greater than about 1000 μm, such as no greater than about 500 μm, such as no greater than about 400 μm, such as no greater than about 350 μm, such as no greater than about 300 μm. In some embodiments, at least 70% by weight of the particles of any particulate or fibrous material referenced herein have a particle size as measured by sieve analysis of no greater than about 1000 μm, such as no greater than about 500 μm, such as no greater than about 400 μm, such as no greater than about 350 μm, such as no greater than about 300 μm. In some embodiments, at least 80% by weight of the particles of any particulate or fibrous material referenced herein have a particle size as measured by sieve analysis of no greater than about 1000 μm, such as no greater than about 500 μm, such as no greater than about 400 μm, such as no greater than about 350 μm, such as no greater than about 300 μm. In some embodiments, at least 90% by weight of the particles of any particulate or fibrous material referenced herein have a particle size as measured by sieve analysis of no greater than about 1000 μm, such as no greater than about 500 μm, such as no greater than about 400 μm, such as no greater than about 350 μm, such as no greater than about 300 μm. In some embodiments, at least 95% by weight of the particles of any particulate or fibrous material referenced herein have a particle size as measured by sieve analysis of no greater than about 1000 μm, such as no greater than about 500 μm, such as no greater than about 400 μm, such as no greater than about 350 μm, such as no greater than about 300 μm. In some embodiments, at least 99% by weight of the particles of any particulate or fibrous material referenced herein have a particle size as measured by sieve analysis of no greater than about 1000 μm, such as no greater than about 500 μm, such as no greater than about 400 μm, such as no greater than about 350 μm, such as no greater than about 300 μm. In some embodiments, approximately 100% by weight of the particles of any particulate or fibrous material referenced herein have a particle size as measured by sieve analysis of no greater than about 1000 μm, such as no greater than about 500 μm, such as no greater than about 400 μm, such as no greater than about 350 μm, such as no greater than about 300 μm.

In some embodiments, at least 50% by weight, such as at least 60% by weight, such as at least 70% by weight, such as at least 80% by weight, such as at least 90% by weight, such as at least 95% by weight, such as at least 99% by weight of the particles of any particulate or fibrous material referenced herein have a particle size as measured by sieve analysis of from about 0.01 μm to about 1000 μm, such as from about 0.05 μm to about 750 μm, such as from about 0.1 μm to about 500 μm, such as from about 0.25 μm to about 500 μm. In some embodiments, at least 50% by weight, such as at least 60% by weight, such as at least 70% by weight, such as at least 80% by weight, such as at least 90% by weight, such as at least 95% by weight, such as at least 99% by weight of the particles of any particulate or fibrous material referenced herein have a particle size as measured by sieve analysis of from about 10 μm to about 400 μm, such as from about 50 μm to about 350 μm, such as from about 100 μm to about 350 μm, such as from about 200 μm to about 300 μm.

In one embodiment is provided a method of preparing a composition as disclosed herein, the method comprising, for example, mixing one or more fillers, at least one active ingredient, and a salt to form a first mixture; and adding water the first mixture to form the composition. In some embodiments, the method further comprises adding one or more binders to the first mixture. In some embodiments, the method further comprises adding a buffer, one or more sweeteners, a humectant, a flavoring, or a combination thereof, to the first mixture. In some embodiments, the method further comprises adding additional water to the composition.

Configured for Oral Use

Provided herein is a product configured for oral use. The term "configured for oral use" as used herein means that the product is provided in a form such that during use, saliva in the mouth of the user causes one or more of the components of the composition (e.g., flavoring agents and/or active ingredients) to pass into the mouth of the user. In certain embodiments, the product is adapted to deliver components to a user through mucous membranes in the user's mouth, the user's digestive system, or both, and, in some instances, said component is an active ingredient (including, but not limited to, for example, a stimulant, vitamin, taste modifier, or combination thereof) that can be absorbed through the mucous membranes in the mouth or absorbed through the digestive tract when the product is used.

Products configured for oral use as described herein may take various forms, including gels, pastilles, tablets, gums, lozenges, powders, and pouches. Gels can be soft or hard. Certain products configured for oral use are in the form of pastilles. As used herein, the term "pastille" refers to a dissolvable oral product made by solidifying a liquid or gel composition so that the final product is a somewhat hardened solid gel. The rigidity of the gel is highly variable. Certain products of the disclosure are in the form of solids. Certain products can exhibit, for example, one or more of the following characteristics: crispy, granular, chewy, syrupy, pasty, fluffy, smooth, and/or creamy. In certain embodiments, the desired textural property can be selected from the group consisting of adhesiveness, cohesiveness, density, dryness, fracturability, graininess, gumminess, hardness, heaviness, moisture absorption, moisture release, mouth-coating, roughness, slipperiness, smoothness, viscosity, wetness, and combinations thereof.

The products comprising the compositions of the present disclosure may be dissolvable. As used herein, the terms "dissolve," "dissolving," and "dissolvable" refer to compositions having aqueous-soluble components that interact with moisture in the oral cavity and enter into solution, thereby causing gradual consumption of the product. According to one aspect, the dissolvable product is capable of lasting in the user's mouth for a given period of time until it completely dissolves. Dissolution rates can vary over a wide range, from about 1 minute or less to about 60 minutes. For example, fast release compositions typically dissolve and/or release the active substance in about 2 minutes or less, often about 1 minute or less (e.g., about 50 seconds or less, about 40 seconds or less, about 30 seconds or less, or about 20 seconds or less). Dissolution can occur by any means, such as melting, mechanical disruption (e.g., chewing), enzymatic or other chemical degradation, or by disruption of the interaction between the components of the composition. In some embodiments, the product can be meltable as discussed, for example, in US Patent App. Pub. No. 2012/0037175 to Cantrell et al. In other embodiments, the products do not dissolve during the product's residence in the user's mouth.

In one embodiment, the product comprising the composition of the present disclosure is in the form of a composition disposed within a moisture-permeable container (e.g., a water-permeable pouch). Such compositions in the water-permeable pouch format are typically used by placing one pouch containing the composition in the mouth of a human subject/user. Generally, the pouch is placed somewhere in the oral cavity of the user, for example under the lips, in the same way as moist snuff products are generally used. The pouch preferably is not chewed or swallowed. Exposure to saliva then causes some of the components of the composition therein (e.g., flavoring agents and/or active ingredients) to pass through e.g., the water-permeable pouch and provide the user with flavor and satisfaction, and the user is not required to spit out any portion of the composition. After about 10 minutes to about 60 minutes, typically about 15 minutes to about 45 minutes, of use/enjoyment, substantial amounts of the composition have been absorbed through oral mucosa of the human subject, and the pouch may be removed from the mouth of the human subject for disposal.

Accordingly, in certain embodiments, the composition as disclosed herein and any other components noted above are combined within a moisture-permeable packet or pouch that acts as a container for use of the composition to provide a pouched product configured for oral use. Certain embodiments of the disclosure will be described with reference to FIG. 1 of the accompanying drawings, and these described embodiments involve snus-type products having an outer pouch and containing a composition as described herein. As explained in greater detail below, such embodiments are provided by way of example only, and the pouched products of the present disclosure can include the composition in other forms. The composition/construction of such packets or pouches, such as the container pouch 10 in the embodiment illustrated in FIG. 1, may be varied. Referring to FIG. 1, there is shown a first embodiment of a pouched product 10. The pouched product 10 includes a moisture-permeable container in the form of a pouch 20, which contains a material 15 comprising a composition as described herein.

Suitable packets, pouches or containers of the type used for the manufacture of smokeless tobacco products may be used for the present pouched embodiments. Examples of such smokeless tobacco products are available under the tradenames CatchDry, Ettan, General, Granit, Goteborgs Rape, Grovsnus White, Metropol Kaktus, Mocca Anis, Mocca Mint, Mocca Wintergreen, Kicks, Probe, Prince, Skruf and TreAnkrare. The composition may be contained in pouches and packaged, in a manner and using the types of components used for the manufacture of conventional snus types of products. The pouch provides a liquid-permeable container of a type that may be considered to be similar in character to the mesh-like type of material that is used for the construction of a tea bag. Components of the composition readily diffuse through the pouch and into the mouth of the user.

Non-limiting examples of suitable types of pouches are set forth in, for example, U.S. Pat. No. 5,167,244 to Kjerstad and U.S. Pat. No. 8,931,493 to Sebastian et al.; as well as US Patent App. Pub. Nos. 2016/0000140 to Sebastian et al.; 2016/0073689 to Sebastian et al.; 2016/0157515 to Chapman et al.; and 2016/0192703 to Sebastian et al., each of which is incorporated herein by reference. Pouches can be provided as individual pouches, or a plurality of pouches (e.g., 2, 4, 5, 10, 12, 15, 20, 25 or 30 pouches) can be connected or linked together (e.g., in an end-to-end manner) such that a single pouch or individual portion can be readily removed for use from a one-piece strand or matrix of pouches.

An example pouch may be manufactured from materials, and in such a manner, such that during use by the user, the pouch undergoes a controlled dispersion or dissolution. Such pouch materials may have the form of a mesh, screen, perforated paper, permeable fabric, or the like. For example, pouch material manufactured from a mesh-like form of rice paper, or perforated rice paper, may dissolve in the mouth of the user. As a result, the pouch and composition each may undergo complete dispersion within the mouth of the user during normal conditions of use, and hence the pouch and composition both may be ingested by the user. Other examples of pouch materials may be manufactured using water dispersible film forming materials (e.g., binding agents such as alginates, carboxymethylcellulose, xanthan gum, pullulan, and the like), as well as those materials in combination with materials such as ground cellulosics (e.g., fine particle size wood pulp). Preferred pouch materials, though water dispersible or dissolvable, may be designed and manufactured such that under conditions of normal use, a significant amount of the composition contents permeate through the pouch material prior to the time that the pouch undergoes loss of its physical integrity. If desired, flavoring ingredients, disintegration aids, and other desired components, may be incorporated within, or applied to, the pouch material.

The amount of material contained within each product unit, for example, a pouch, may vary. In some embodiments, the weight of the composition within each pouch is at least about 50 mg, for example, from about 50 mg to about 1 gram, from about 100 to 800 about mg, or from about 200 to about 700 mg. In some smaller embodiments, the weight of the composition within each pouch may be from about 100 to about 300 mg. For a larger embodiment, the weight of the material within each pouch may be from about 300 mg to about 700 mg. If desired, other components can be contained within each pouch. For example, at least one flavored strip, piece or sheet of flavored water dispersible or water soluble material (e.g., a breath-freshening edible film type of material) may be disposed within each pouch along with or without at least one capsule. Such strips or sheets may be folded or crumpled in order to be readily incorporated within the pouch. See, for example, the types of materials and technologies set forth in U.S. Pat. No. 6,887,307 to Scott et al. and U.S. Pat. No. 6,923,981 to Leung et al.; and The EFSA Journal (2004) 85, 1-32; which are incorporated herein by reference.

In certain embodiments, one or more active ingredients as described herein are included in the composition within the pouched product, and one or more further active ingredients are disposed in or on the external surface of the product (e.g., on or in the pouch material as disclosed herein). In some embodiments, separate location of the active ingredients may allow differential release profiles (e.g., one active ingredient may be rapidly available to the mouth and/or digestive system, and the other active ingredient may be released more gradually with product use).

A pouched product as described herein can be packaged within any suitable inner packaging material and/or outer container, such as those utilized for smokeless tobacco products. See, for example, the various types of containers for smokeless types of products that are set forth in U.S. Pat. No. 7,014,039 to Henson et al.; U.S. Pat. No. 7,537,110 to Kutsch et al.; U.S. Pat. No. 7,584,843 to Kutsch et al.; U.S. Pat. No. 8,397,945 to Gelardi et al., D592,956 to Thiellier; D594,154 to Patel et al.; and D625,178 to Bailey et al.; US Pat. Pub. Nos. 2008/0173317 to Robinson et al.; 2009/0014343 to Clark et al.; 2009/0014450 to Bjorkholm; 2009/0250360 to Bellamah et al.; 2009/0266837 to Gelardi et al.; 2009/0223989 to Gelardi; 2009/0230003 to Thiellier; 2010/0084424 to Gelardi; and 2010/0133140 to Bailey et al; 2010/0264157 to Bailey et al.; and 2011/0168712 to Bailey et al. which are incorporated herein by reference.

Many modifications and other embodiments of the invention will come to mind to one skilled in the art to which this invention pertains having the benefit of the teachings presented in the foregoing description. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

EXAMPLES

Aspects of the present invention are more fully illustrated by the following examples, which are set forth to illustrate certain aspects of the present invention and is not to be construed as limiting thereof.

Example 1

Wheat Straw Dissolving Pulp

Wheat straw dissolving pulp was provided in the form of a moist pulp. The wheat straw dissolving pulp was dried to a flake-like structure, as illustrated in FIG. 2. The dissolving pulp was dried in a Retsch table-top hot air pulp dryer at about 60° C. for about 2 hours. The moisture level of the dissolving pulp after drying was about 2% water, based on the total weight of the dried pulp material.

The dried dissolving pulp was ground using a table top grinder (Retsch Centrifugal grinder (ZM 1) with a nominal power of 600 W). The output of the grinder was 400 ml per hour at a rotation speed of 15,000 rpm. The dissolving pulp was ground with a closed mill condition (i.e., the dissolving pulp material was fed into a closed container within the mill). The wheat dissolving pulp was ground one time, with a grinding mesh size of 2.0 mm. The wheat dissolving pulp after grinding is illustrated in FIGS. 3A and 3B. As shown, the grinding produced a fluffy, fibrous structure from the dry flake.

To measure the density of the material after grinding, the ground material was poured in a graded measurement glass. The measurement glass was manually shaken to reduce any visual material bridging or voids between fiber clusters. At the even level of 100 ml, the glass was put on a two decimals per gram scale and the weight was recorded. The density of the ground wheat dissolving pulp was calculated to be 37 g/L.

Example 2

Hardwood Dissolving Pulp

Hardwood sulphate dissolving pulp (birch) was provided in the form of dry sheets. Such starting materials typically have a density in the range of 700-800 g/L. The hardwood dissolving pulp was ground one time, with a grinding mesh size of 2.0 mm using the same equipment as in Example 1. The output of the grinder was 220 ml per hour at a rotation speed of 15,000 rpm. The irregular, fibrous shapes of the hardwood pulp after grinding are shown in FIG. 4. Density of the ground hardwood dissolving pulp was calculated as 25 g/L using the same method as set forth in Example 1.

Example 3

Softwood Dissolving Pulp

Softwood dissolving pulp (spruce) was provided in the form of dry sheets. Such starting materials typically have a density in the range of 700-800 g/L. The softwood dissolving pulp was initially ground one time, with a grinding mesh size of 2.0 mm using the same equipment as in Example 1. The output of the grinder was 280 ml per hour at a rotation speed of 15,000 rpm. The density of the ground softwood dissolving pulp, calculated as described in Example 1, was 21 g/L. The long irregular, cluster-like shapes of the softwood pulp after the first grinding are shown in FIG. 5.

The softwood was then ground a second time, with a grinding mesh size of 2.0 mm. The output of the grinder was 1600 ml per hour at a rotation speed of 15,000 rpm. The density of the ground softwood dissolving pulp after the second grinding was 26 g/L.

The softwood was then ground a third time, with a grinding mesh size of 1.0 mm. The output of the grinder was 600 ml per hour at a rotation speed of 15,000 rpm. The density of the ground softwood dissolving pulp after the third grinding was 32 g/L.

As noted above, without intending to be limited by theory, it is hypothesized that a gently ground fiber from a dissolving pulp that is not fully collapsed, not only maintains the fiber bulk filling properties, but also likely improves them by making the shape of the fibers irregular and decreasing the density of the material. The results above demonstrate that increasing mechanical treatment will eventually lead to a denser product. Without intending to be limited by theory, it is believed that a mechanical treatment of greater intensity will give rise to increased material collapse (i.e., shorter, denser pieces). Thus, for each starting material, there is likely an optimal level of density that can be reached through mechanical treatment of the pulp, after which density will begin to decline. This optimal level of density can be determined experimentally using the basic process set forth above (i.e., repeatedly grinding the material with intermittent measurement of bulk density).

Example 4

Oral Product Preparation

A standard recipe for commercial product, LYFT Lime Strong, was prepared using an EKOMEX 1500L paddle-blender, except 10 weight percent of the microcrystalline cellulose (MCC) component was excluded from the dryblending step. A 2000 g sample of the above base composition was blended in a food blender with a sufficient amount of MCC to compensate for the 10 weight percentage of MCC initially left out of the composition to form a homogenous base composition.

A comparison oral product composition was prepared having only microcrystalline cellulose (MCC) as a filler component by blending a 45 g sample of the homogenous base composition with 5 g of MCC and 15 g of water in a food blender to form a comparative composition.

As an example embodiment of the invention, a 45 g sample of the homogenous base composition was blended with 2.6 g of a wheat straw dissolving pulp that has been ground according to Example 1 above and 15 g of water in a food blender to provide an example embodiment.

The comparative composition and the example embodiment were placed in separate volumetric jars with volume gradations to appreciate the volumetric fill difference. Based on visual inspection, the example embodiment comprising the wheat straw dissolving grade pulp provided a material with a higher volume than the comparative composition, illustrating that use of the wheat straw dissolving grade pulp had an impact on overall density of the material. The difference in density was estimated to be approximately 27%.

What is claimed is:

1. A composition adapted for oral use, comprising:

one or more fillers present in a total filler content of about 20% by weight or higher, based on the total weight of the composition, the one or more fillers comprising a first filler in the form of a dissolving grade pulp material, the first filler having an untapped bulk density of about 150 g/L or less; and at least one additional component selected from the group consisting of active ingredients, flavorants, and combinations thereof.

2. The composition of claim 1, wherein the dissolving grade pulp material is derived from a plant source selected from the group consisting of wood sources, agricultural residue sources, annual plants and grasses, recycled plant material, and combinations thereof.

3. The composition of claim 1, wherein the dissolving grade pulp material is derived from a plant source selected from the group consisting of maize, oat, rice, barley, rye, buckwheat, sugar beet, bran, bamboo, hardwood, softwood, cotton, citrus, willow, cocoa, abaca, bagasse, esparto, eucalyptus, hemp, jute, kenaf, flax, sisal, and combinations thereof.

4. The composition of claim 1, wherein the dissolving grade pulp material is a hardwood or softwood dissolving grade pulp or a wheat straw dissolving grade pulp.

5. The composition of claim 1, wherein the dissolving grade pulp material has an untapped bulk density in the range of about 15 g/L to about 50 g/L.

6. The composition of claim 1, wherein the first filler is present in an amount in the range of about 2 to about 10 weight percent, based on the total weight of the composition.

7. The composition of claim 6, wherein the first filler is present in an amount in the range of about 3 to about 6 weight percent, based on the total weight of the composition.

8. The composition of claim 1, wherein the total filler content is about 30 weight percent or higher, based on the total weight of the composition.

9. The composition of claim 1, wherein the total filler content is about 40 weight percent or higher, based on the total weight of the composition.

10. The composition of claim 1, wherein the total filler content is in the range of about 20 weight percent to about 60 weight percent, based on the total weight of the composition.

11. The composition of claim 1, further comprising a second filler in the form of a non-tobacco cellulosic material having a bulk density of about 250 g/L or higher.

12. The composition of claim 11, wherein the non-tobacco cellulosic material has a bulk density in the range of about 250 g/L to about 1200 g/L.

13. The composition of claim 11, wherein the non-tobacco cellulosic material is microcrystalline cellulose.

14. The composition of claim 13, wherein the microcrystalline cellulose of the second filler has a particle size in the range of about 75 microns to about 150 microns.

15. The composition of claim 11, wherein the second filler is in particulate form and the first filler is in fibrous form.

16. The composition of claim 1, wherein the composition has a moisture content of about 30% by weight or higher, based on the total weight of the composition.

17. The composition of claim 1, wherein the moisture content of the composition is in the range of about 30 weight percent to about 60 weight percent, based on the total weight of the composition.

18. The composition of claim 1, wherein the moisture content of the composition is in the range of about 40 weight percent to about 55 weight percent, based on the total weight of the composition.

19. The composition of claim 1, wherein the at least one additional component comprises at least one active ingredient selected from the group consisting of botanical materials, stimulants, amino acids, vitamins, antioxidants, cannabinoids, cannabimimetics, terpenes, pharmaceutical agents, and combinations thereof.

20. The composition of claim 1, further comprising one or more of the following: a salt, a sweetener, a buffer, a humectant, a binder, and combinations thereof.

21. The composition of claim 1, wherein the composition comprises up to about 5 weight percent of tobacco, based on the total weight of the composition, the tobacco optionally being in a bleached form.

22. The composition of claim 1, wherein the composition is substantially free of tobacco.

23. The composition of claim 1, wherein the composition is substantially free of nicotine.

24. The composition of claim 1, wherein the composition comprises a nicotine component.

25. The composition of claim 1, wherein the composition is enclosed in a pouch to form a pouched product.

26. A method of forming a composition adapted for oral use, comprising:

providing a dissolving grade pulp material having a moisture content of about 10% or less;

grinding the dissolving grade pulp material to form a pulp material having an untapped bulk density of about 150 g/L or less;

mixing the pulp material with at least one additional component selected from the group consisting of active ingredients, flavorants, and combinations thereof to form an oral composition adapted for oral use, wherein the oral composition comprises one or more fillers present in a total filler content of about 20% by weight or higher, based on the total weight of the composition, the one or more fillers comprising the pulp material.

27. The method of claim 26, wherein the dissolving grade pulp material is in a flake or sheet form prior to grinding.

28. The method of claim 26, further comprising mixing the pulp material with a non-tobacco cellulosic material having a bulk density of about 250 g/L or higher.

29. The method of claim 28, wherein the non-tobacco cellulosic material is a wood-derived microcrystalline cellulose material.

30. The method of claim 29, wherein the dissolving grade pulp material is derived from a plant source selected from the group consisting of wood sources, agricultural residue sources, annual plants and grasses, recycled plant material, and combinations thereof.

31. The method of claim 26, wherein the dissolving grade pulp material is derived from a plant source selected from the group consisting of maize, oat, rice, barley, rye, buckwheat, sugar beet, bran, bamboo, hardwood, softwood, cotton, citrus, willow, cocoa, abaca, bagasse, esparto, eucalyptus, hemp, jute, kenaf, flax, sisal, and combinations thereof.

32. The method of claim 26, wherein the dissolving grade pulp material is a hardwood or softwood dissolving grade pulp or a wheat straw dissolving grade pulp.

33. The method of claim 26, wherein the pulp material has an untapped bulk density in the range of about 15 g/L to about 50 g/L.

34. A composition adapted for oral use, comprising:

one or more fillers present in a total filler content of about 40% by weight or higher, based on the total weight of the composition, the one or more fillers comprising a first filler in the form of a dissolving grade pulp material, the first filler having an untapped bulk density of about 150 g/L or less; and a nicotine component, wherein the composition is enclosed in a pouch to form a pouched product.

35. The composition of claim 34, wherein the moisture content of the composition is in the range of about 30 weight percent to about 60 weight percent, based on the total weight of the composition.

36. The composition of claim 35, wherein the composition is substantially free of tobacco.

* * * * *